US011209769B2

(12) United States Patent
Sakai et al.

(10) Patent No.: US 11,209,769 B2
(45) Date of Patent: Dec. 28, 2021

(54) POWDER RECOVERY CONTAINER

(71) Applicant: FUJIFILM Business Innovation Corp., Tokyo (JP)

(72) Inventors: Yusuke Sakai, Kanagawa (JP); Lei Yuan, Kanagawa (JP); Satoshi Hashimoto, Kanagawa (JP); Hirohisa Hoshino, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/988,708

(22) Filed: Aug. 9, 2020

(65) Prior Publication Data

US 2021/0302904 A1 Sep. 30, 2021

(30) Foreign Application Priority Data

Mar. 26, 2020 (JP) ..... JP2020-056881

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)

(58) Field of Classification Search
CPC ..... G03G 21/12; G03G 21/105
See application file for complete search history.

(56) References Cited

U.S. PATENT DOCUMENTS 8,270,852 B2 * 9/2012 Ando ..... G03G 21/12 399/10
8,290,421 B2 * 10/2012 Sato ..... G03G 21/105 399/360
8,417,172 B2 * 4/2013 Sato ..... G03G 21/12 399/360
8,639,132 B2 * 1/2014 Sato ..... G03G 21/12 399/35

FOREIGN PATENT DOCUMENTS

JP 2017-054085 3/2017
JP 6551093 7/2019

* cited by examiner

*Primary Examiner* — Walter L Lindsay, Jr.
*Assistant Examiner* — Milton Gonzalez
(74) *Attorney, Agent, or Firm* — JCIPRNET

(57) ABSTRACT

A recovery container includes a container body that is removably attached to an attachment target and that is capable of recovering powder; a projection provided at a distance from the container body in a direction intersecting with an attachment direction of the container body and having a slip-off preventing portion that is formed at a portion on a side opposite to an attachment direction side and that is engaged with an engaging part provided at the attachment target; an urging member that is provided between the container body and the projection and that urges the projection away from the container body; and an inclined portion formed at the projection and inclined so as to be gradually separated from the container body, in the attachment direction from the slip-off preventing portion.

20 Claims, 17 Drawing Sheets

POWDER RECOVERY CONTAINER

CROSS-REFERENCE TO RELATED APPLICATIONS

This application is based on and claims priority under 35 USC 119 from Japanese Patent Application No. 2020-056881 filed Mar. 26, 2020.

BACKGROUND

(i) Technical Field

The present disclosure relates to a recovery container.

(ii) Related Art

Japanese Patent No. 6551093 discloses a powder recovery container that is removably attached to an image forming apparatus.

In a known system, a powder recovery container has, at a side part thereof, an urging member supported at one end and having a projection. When the projection provided at the urging member is engaged with an engaging part provided at an apparatus body of an image forming apparatus, the recovery container is held by the apparatus body. When the recovery container is not sufficiently pushed into the apparatus body, faulty engagement may occur, in which a slip-off preventing portion provided at the projection is not engaged with the engaging part.

SUMMARY

Aspects of non-limiting embodiments of the present disclosure relate to, in a configuration in which a recovery container is held by an attachment target when a slip-off preventing portion of a projection provided at the recovery container is engaged with an engaging part provided on the attachment target, suppressing faulty engagement, in which the projection is not engaged with the engaging part, compared with a configuration in which the projection has a flat portion extending from the slip-off preventing portion in an attachment direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recovery container includes a container body that is removably attached to an attachment target and that is capable of recovering powder; a projection provided at a distance from the container body in a direction intersecting with an attachment direction of the container body and having a slip-off preventing portion that is formed at a portion on a side opposite to an attachment direction side and that is engaged with an engaging part provided at the attachment target; an urging member that is provided between the container body and the projection and that urges the projection away from the container body; and an inclined portion formed at the projection and inclined so as to be gradually separated from the container body, in the attachment direction from the slip-off preventing portion.

BRIEF DESCRIPTION OF THE DRAWINGS

An exemplary embodiment of the present disclosure will be described in detail based on the following figures, wherein.

DETAILED DESCRIPTION

A recovery container and a powder application apparatus according to an exemplary embodiment of the present disclosure will be described.

First, an image forming apparatus 10, serving as an example of a powder application apparatus according to this exemplary embodiment, will be described. Then, a recovery container 60 used in the image forming apparatus 10 will be described.

Overall Configuration

First, the image forming apparatus 10 according to this exemplary embodiment will be described.

Figure 1:
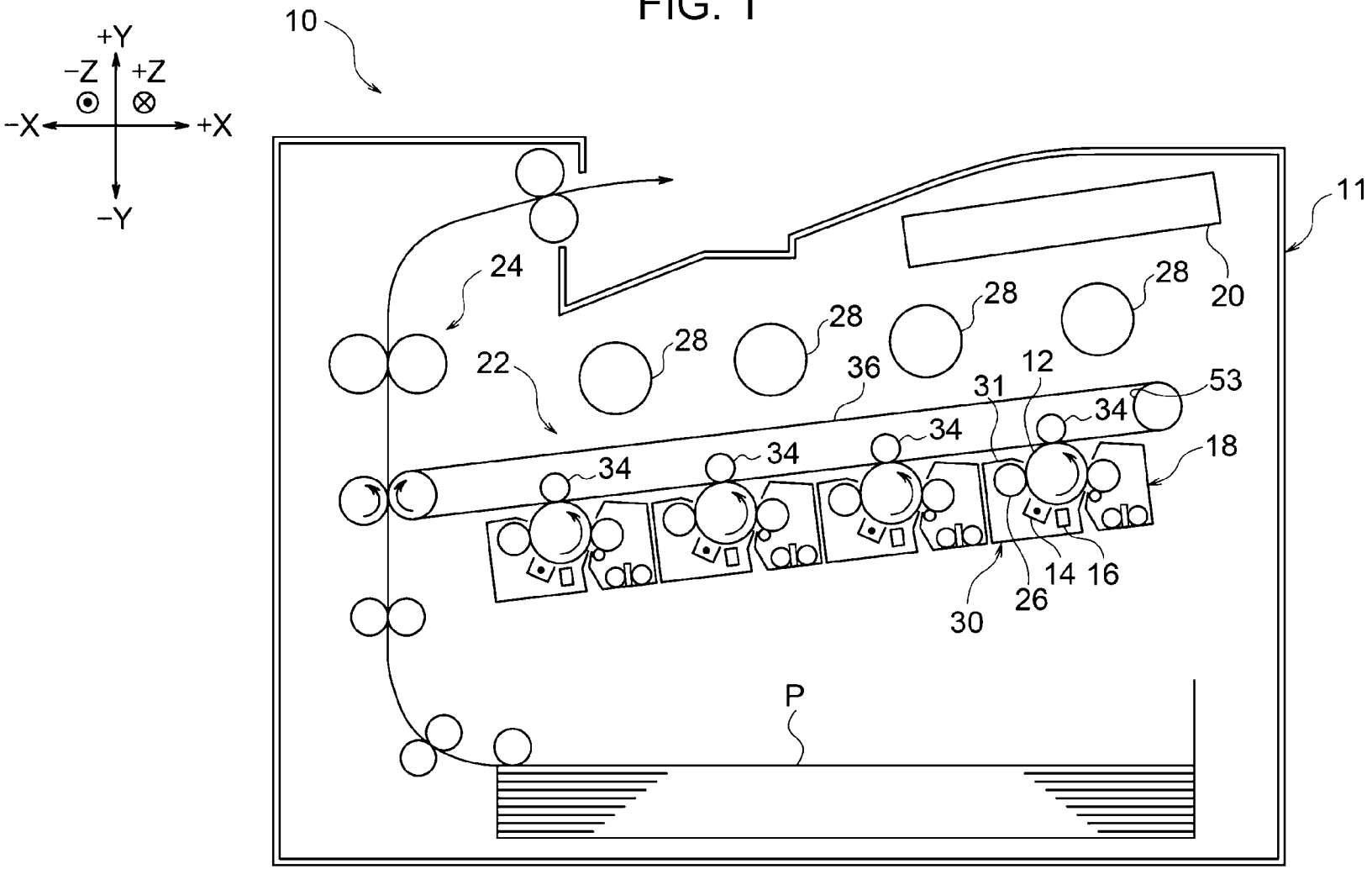
FIG. 1 schematically shows an image forming apparatus according to an exemplary embodiment of the present disclosure.
Figure 2:
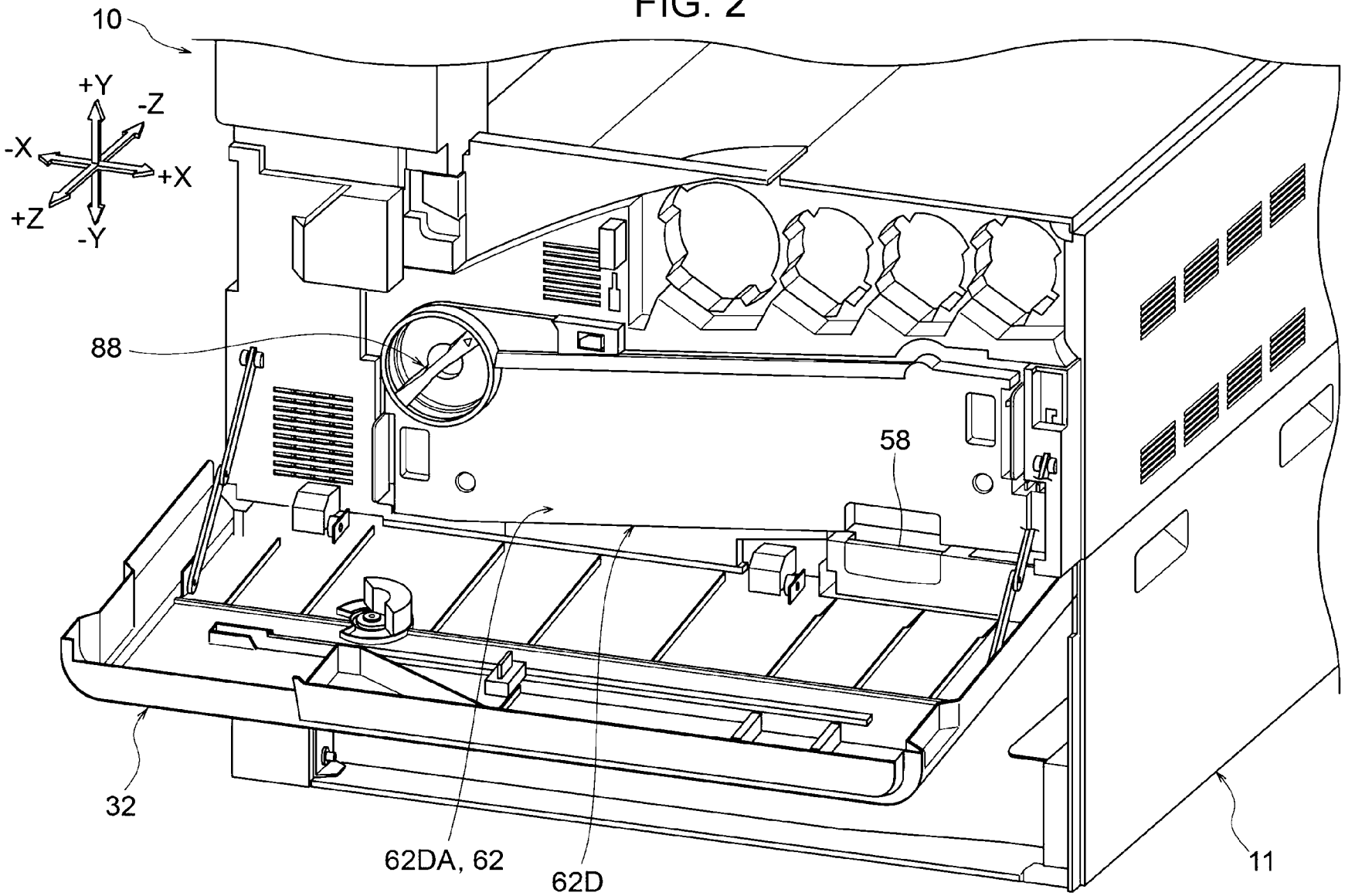
FIG. 2 is a perspective view of the image forming apparatus according to the exemplary embodiment of the present disclosure, showing a state in which a cover is open.

As shown in FIGS. 1 and 2, the image forming apparatus 10 includes a housing 11, serving as an apparatus body. As shown in FIG. 1, the image forming apparatus 10 also includes, inside of the housing 11: photoconductors 12, serving as an example of an image carrier; charging devices 14, serving as an example of a charging part; exposure devices 16, serving as an example of an exposure part; developing devices 18, serving as an example of a supply part; a controller 20, serving as an example of a control part; a transfer device 22, serving as an example of a transfer part; a fixing device 24, serving as an example of a fixing part; cleaning devices 26, serving as an example of a cleaning part; and toner cartridges 28, serving as an example of a powder container. The photoconductors 12, the charging devices 14, the exposure devices 16, and the cleaning devices 26 constitute photoconductor units 30, serving as an example of an image carrier unit. Housings 31 of the photoconductor units 30 are removably attached to the housing 11.

In the description below, in a front view of the image forming apparatus 10 (i.e., when the image forming apparatus 10 is viewed from the side where a user (not shown) stands), the apparatus width direction, the apparatus height direction, and the apparatus depth direction will be referred to as the X direction, the Y direction, and the Z direction. The X, Y, and Z directions are perpendicular to one another. When one side and the other side in the X, Y, and Z directions need to be distinguished, in the front view of the image forming apparatus 10, the upper side of the image forming apparatus 10 is referred to as +Y side, the lower side is referred to as −Y side, the right side is referred to as +X side, the left side is referred to as −X side, the far side is referred to as +Z side, and the front side is referred to as −Z side. The Y direction is an example of the gravity direction. The X and Z directions are an example of the horizontal direction.

As shown in FIG. 2, a cover 32 capable of being pivoted to the front side in the apparatus depth direction is attached to the front side of the housing 11. On the far side of the cover 32 in the apparatus depth direction, a recovery container 60 for developer, which serves as a colorant and which is an example of powder, is removably attached to the housing 11, serving as an example of an attachment target. More specifically, the housing 11 has a storage part 50 having a shape corresponding to the external shape of the recovery container 60, and the recovery container 60 is stored in the storage part 50 and thus attached to the housing 11. The width direction, the height direction, and the thickness direction of the recovery container 60 in a state attached to the housing 11 are equal to the apparatus width direction, the apparatus height direction, and the apparatus depth direction. Accordingly, in a front view of the recovery container 60, the upper side, the lower side, the right side, the left side, the far side, and the front side of the recovery container 60 correspond to the +Y side, −Y side, +X side, −X side, +Z side, and −Z side, respectively.

Figure 11:
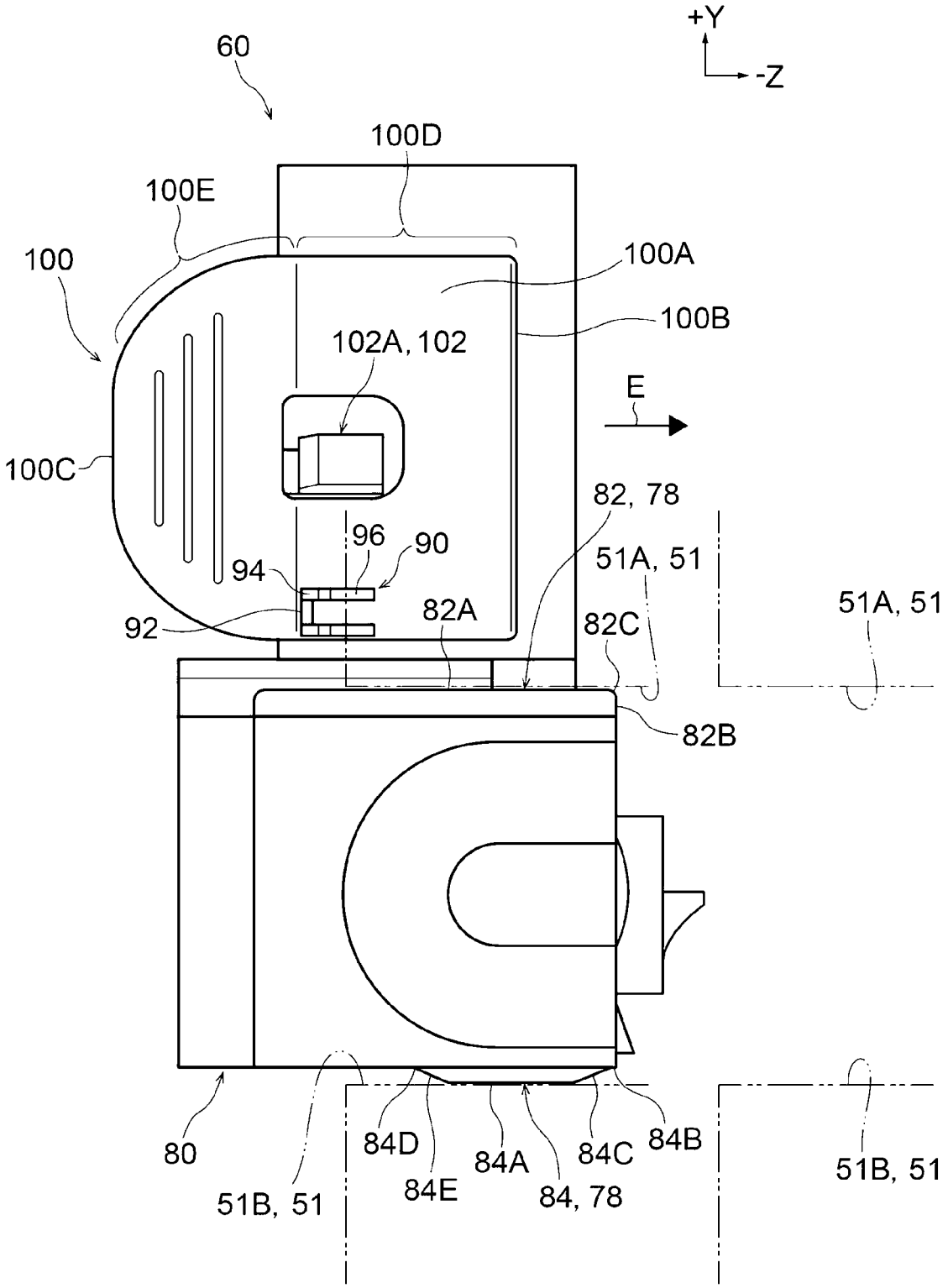
FIG. 11 is a side view of the relevant part of the recovery container in FIG. 9, as viewed from the side.

In FIG. 11, the arrow E shows an attachment direction, in which the recovery container 60 (container body 62) is attached to the housing 11. The attachment direction is equal to the direction toward the far side in the apparatus depth direction.

Figure 3:
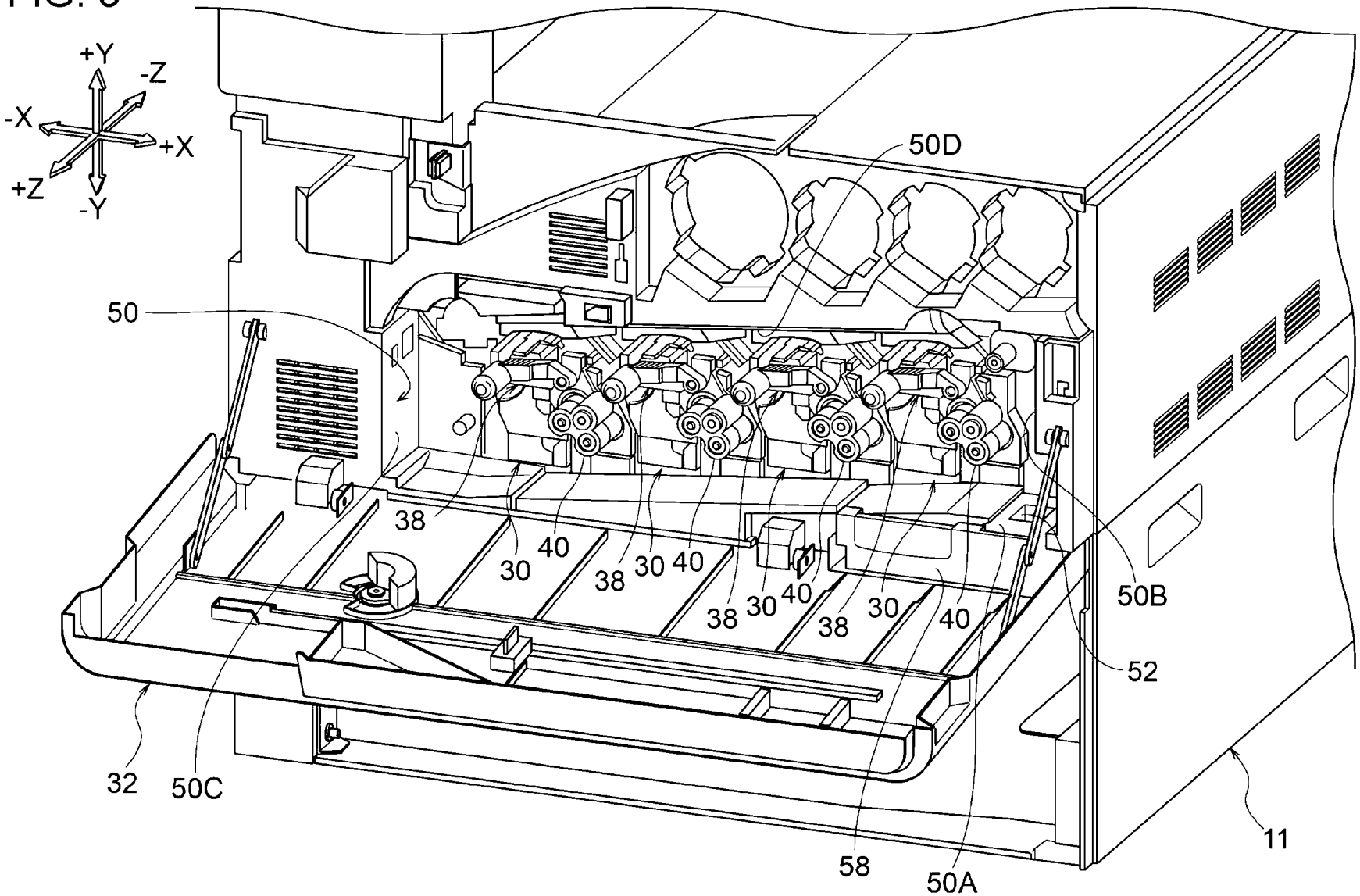
FIG. 3 is a perspective view of the image forming apparatus in FIG. 2, showing a state in which a recovery container is removed.
Figure 4:
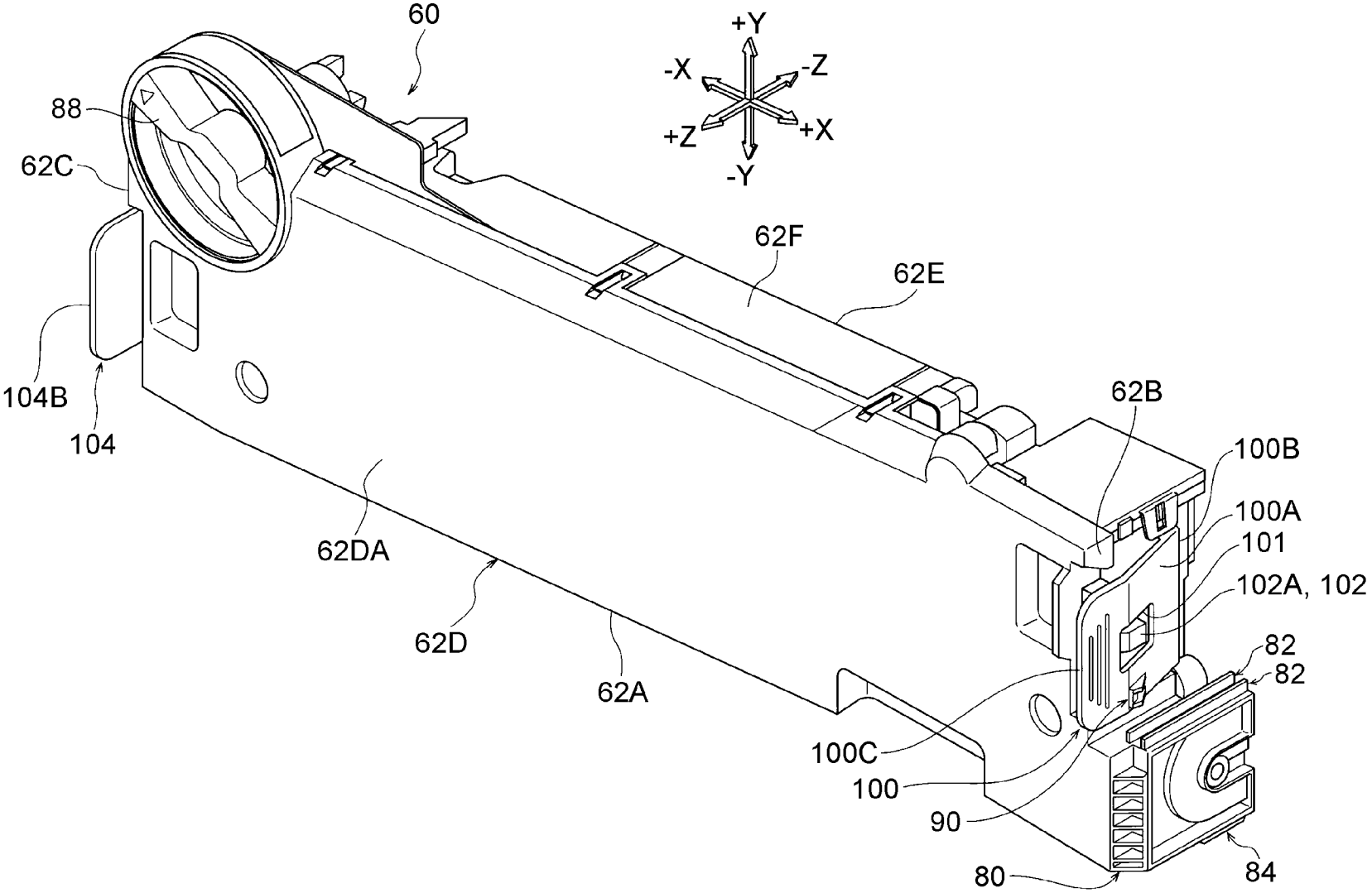
FIG. 4 is a perspective view of the recovery container of the image forming apparatus according to the exemplary embodiment of the present disclosure, as viewed from the front side, showing a state in which the recovery container is attached to a housing.
Figure 7:
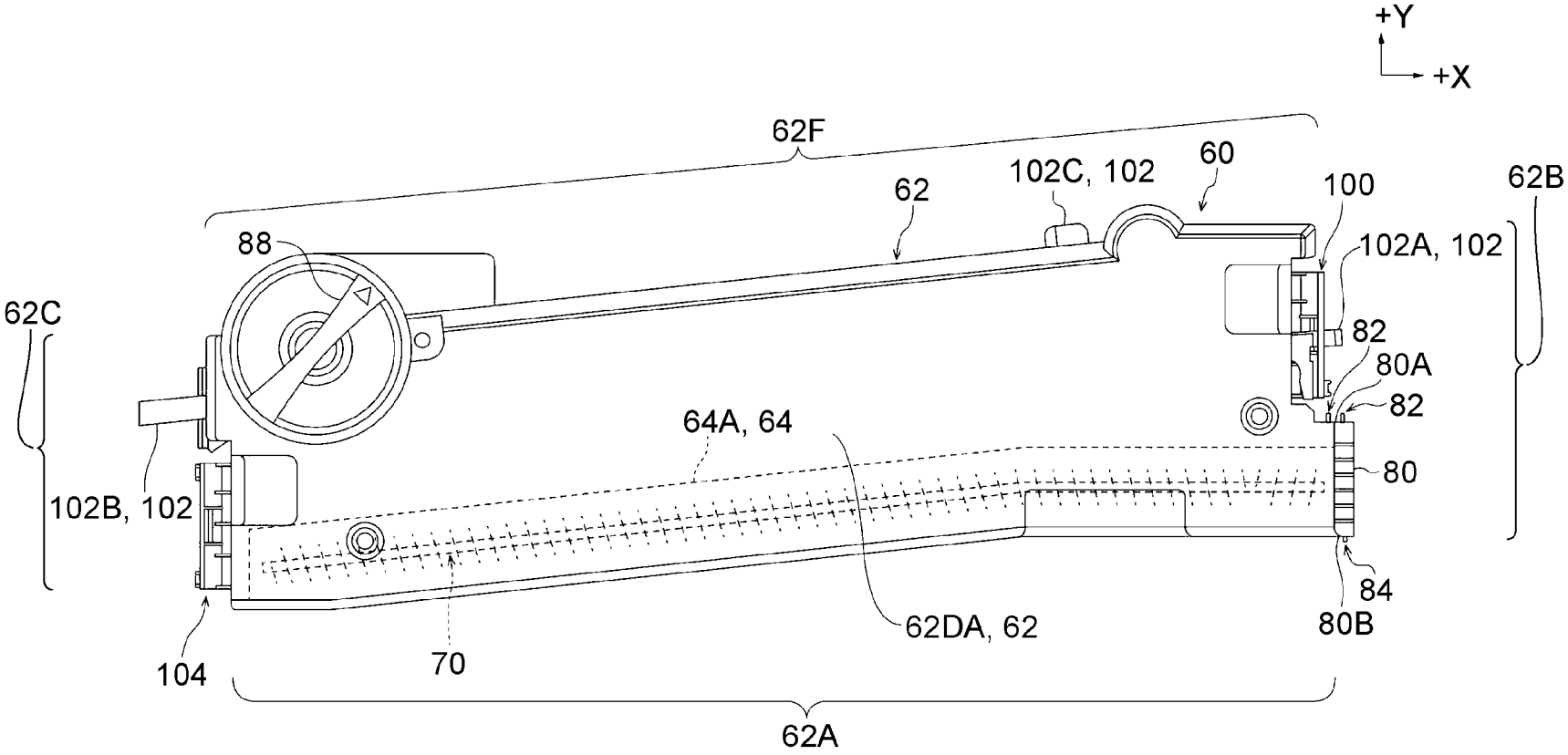
FIG. 7 is a front view of the recovery container in FIG. 5.
Figure 8:
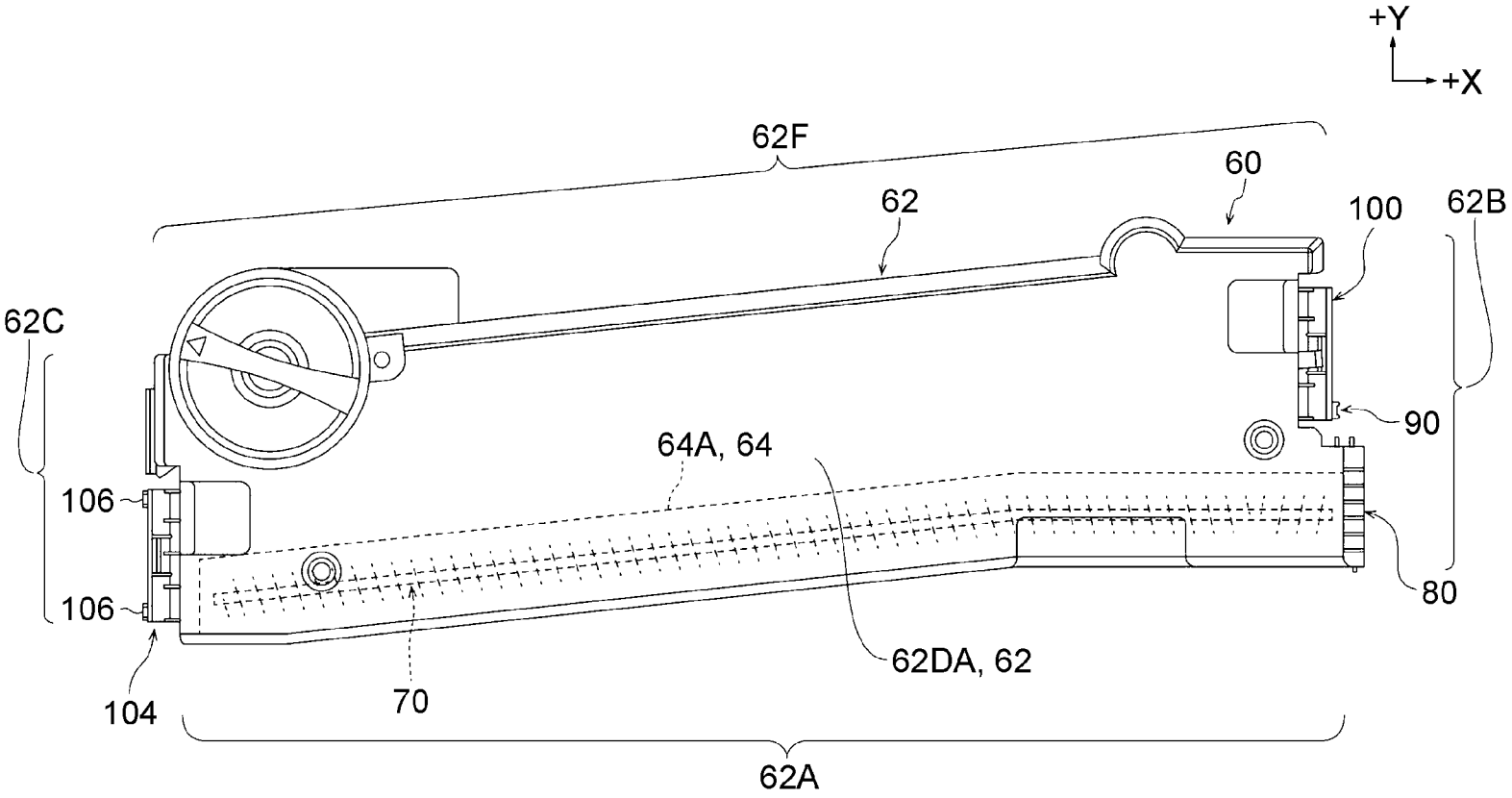
FIG. 8 is a back view of the recovery container in FIG. 6.

As shown in FIGS. 7 and 8, an operation handle 88, serving as an example of an operation member, is provided on a front part 62D of the recovery container 60 (i.e., a front-side part of the container body 62 in the apparatus depth direction). By operating the operation handle 88, the recovery container 60 locked in the housing 11 is released, and recovery ports 66 from which developer, serving as an example of powder, is recovered are closed. In association with the operation of the operation handle 88, the first transfer rollers 34 of the transfer device 22 move away from the photoconductors 12. Then, by removing the recovery container 60 from the housing 11, the photoconductor units 30 corresponding to respective colors, attached to the housing 11, are exposed to the outside (see FIG. 3) and become accessible.

After the recovery container 60 is removed, operation levers 38 provided on the developing devices 18 are operated so as to be retracted from removal paths for the photoconductor units 30. Then, by pulling the photoconductor units 30 toward the front side in the apparatus depth direction, the photoconductor units 30 are removed from the housing 11.

Next, the operation of the image forming apparatus 10 will be described.

The operations of the respective components of the image forming apparatus 10 are controlled by the controller 20. In the image forming apparatus 10, the developing devices 18 develop latent images on the photoconductors 12 with developer, which serves as colorant and is an example of powder, transported from the toner cartridges 28 to form toner images, serving as an example of a developer image. Furthermore, in the image forming apparatus 10, after the transfer device 22 transfers the toner images to a recording medium P, the toner images are fixed to the recording medium P by the fixing device 24.

The developer contains, for example: toner, serving as an example of negatively charged colorant; iron carrier, serving as an example of a positively charged magnetic material; and additives. The toner and the carrier are major ingredients of the developer. The toner is made of, for example, polyester resin.

Configuration of Relevant Part

Next, the recovery container 60 according to this exemplary embodiment will be described in detail.

The developer used in the developing devices 18, the developer removed from an intermediate transfer belt 36, and the developer removed from the photoconductors 12 are recovered in the recovery container 60 according to this exemplary embodiment. Then, the recovered developer is aggregated and is discharged from an external discharge port (see FIGS. 12A to 12C, described below) to a recovery bottle 58 (see FIGS. 2 and 12) located at the lower part of the housing 11. In the present disclosure, "recover" represents to temporarily or permanently hold the powder therein.

As shown in FIGS. 4 to 8, the recovery container 60 includes the container body 62.

The container body 62 has a box shape and has a recovery path 64 in which developer is recovered. The container body 62 is stored in the storage part 50 of the housing 11 and is attached to the housing 11. As described above, because the storage part 50 has a shape conforming to the external shape of the recovery container 60 (container body 62), the container body 62 covers the photoconductors 12 and the transfer device 22, in a state in which the container body 62 is stored in the storage part 50.

The recovery path 64 is a passage in which the developer recovered from the recovery ports 66 (described below) is aggregated and is transported to the external discharge port 68. The recovery path 64 includes branch passages (not shown) extending downward from the recovery ports 66, and a principal passage 64A to which the branch passages are joined. The principal passage 64A is provided at the lower part of the container body 62 and extends from one side (right side in FIGS. 7 and 8) toward the other side (left side in FIGS. 7 and 8) in the width direction of the container body 62. The developer recovered in the principal passage 64A is transported from one side (left side in FIGS. 7 and 8) toward the other side (right side in FIGS. 7 and 8) in an extending direction in which the principal passage 64A extends. More specifically, a transport auger 70, serving as an example of a transport member, is provided in the principal passage 64A so as to rotate about an axis along the extending direction of the principal passage 64A. As the transport auger 70 rotates, the developer in the principal passage 64A is transported from the other side toward one side in the width direction of the container body 62.

Figure 12A:
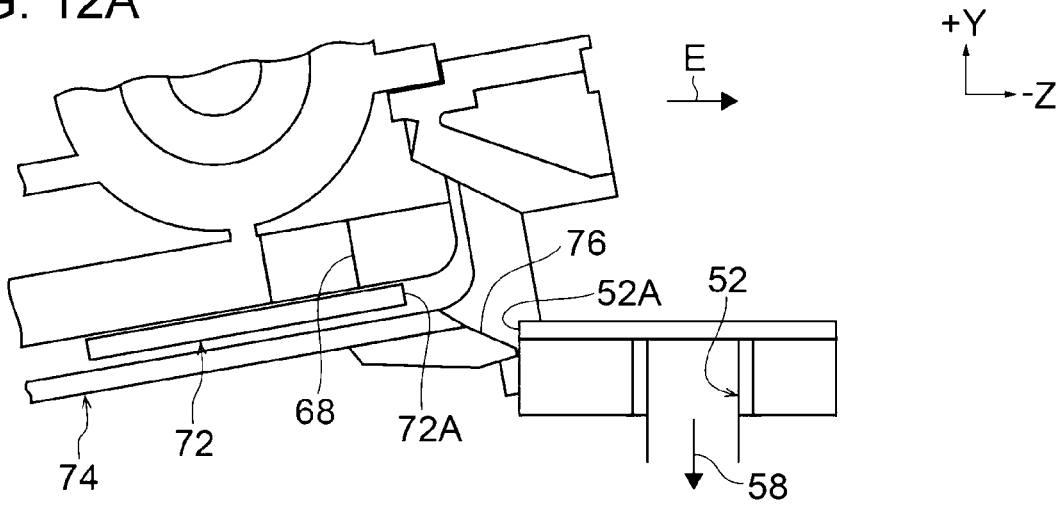
FIG. 12A is an enlarged side view of the relevant part showing the operation of guiding a periphery of a recovery port in the housing with an inclined portion and a guide part of the recovery container.
Figure 12B:
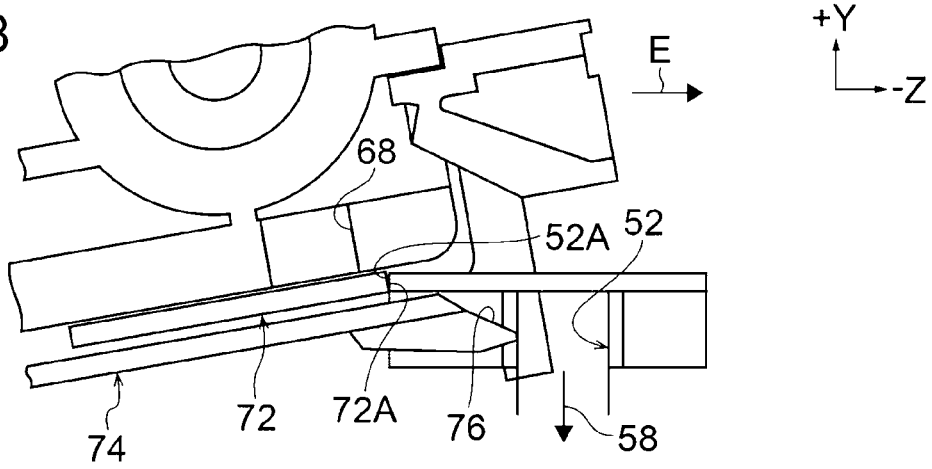
FIG. 12B is an enlarged side view of the relevant part showing the operation of push-opening an opening/closing shutter that closes an external discharge port with the periphery of the recovery port guided in FIG. 12A.
Figure 12C:
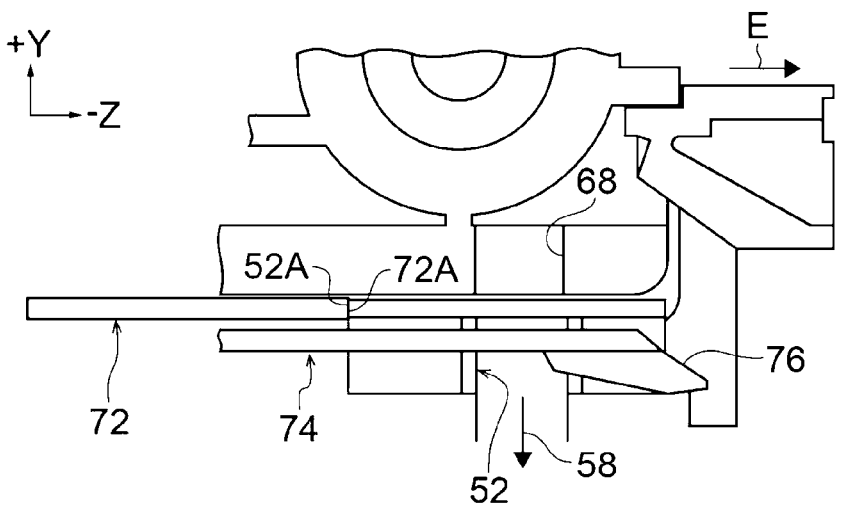
FIG. 12C is an enlarged side view of the relevant part showing a state in which the opening/closing shutter is completely push-opened in FIG. 12B, and the external discharge port and the recovery port are connected.

The container body 62 has, in a bottom 62A, the external discharge port 68 (see FIGS. 12A to 12C). More specifically, the external discharge port 68 is provided at the other end portion of the principal passage 64A in the extending direction thereof and opens downward. The developer transported through the principal passage 64A is discharged outside through the external discharge port 68. In this exemplary embodiment, in a state in which the recovery container 60 is attached to the housing 11, the external discharge port 68 is connected to a recovery port 52 provided in a bottom surface 50A of the storage part 50. The recovery port 52 is connected to the mouth of the recovery bottle 58 attached to the housing 11, below the storage part 50. Thus, the developer discharged from the external discharge port 68 is collected in the recovery bottle 58 through the recovery port 52.

An opening/closing shutter 72, serving as an example of an opening/closing part and is urged in an attachment direction E by a spring member (for example, a coil spring; not shown) to close the external discharge port 68, is provided at a portion in the bottom 62A of the container body 62 corresponding to the external discharge port 68. In an attached state in which the container body 62 is attached to the housing 11, the opening/closing shutter 72 is push-opened by a flange portion 52A of the recovery port 52. More specifically, when the container body 62 is moved in the attachment direction E, relative to the housing 11, the flange portion 52A of the recovery port 52 comes into contact with an end 72A of the opening/closing shutter 72 on the attachment direction E side, as shown in FIGS. 12A to 12C. When the container body 62 is moved further in the attachment direction E, the opening/closing shutter 72 is pushed in the direction opposite to the attachment direction E, opening the external discharge port 68. Thus, the external discharge port 68 and the recovery port 52 are connected.

Guide parts 74 that guide the movement of the opening/closing shutter 72 are provided in the container body 62, on the opposite side of the opening/closing shutter 72 from the external discharge port 68. The guide parts 74 are flat surfaces extending in the thickness direction of the container body 62 (the attachment direction E).

Furthermore, as shown in FIGS. 10 and 12A to 12C, the guide parts 74 have inclined portions 76 extending obliquely in a direction away from the opening/closing shutter 72, in the attachment direction E from the ends thereof on the attachment direction E side. The inclined portions 76 are flat surfaces extending obliquely downward in the attachment direction E, when the guide parts 74 are viewed in the width direction of the container body 62. The inclined portions 76 is capable of guiding the flange portion 52A of the recovery port 52 to the opening/closing shutter 72. More specifically, when the flange portion 52A of the recovery port 52 comes into contact with the inclined portions 76 when the container body 62 is attached to the housing 11, the flange portion 52A of the recovery port 52 is guided by the inclined portions 76 to a position between the external discharge port 68 and the guide parts 74 in the height direction of the container body 62. The thus guided flange portion 52A of the recovery port 52 comes into contact with the end 72A of the opening/closing shutter 72 and pushes the opening/closing shutter 72.

Figure 10:
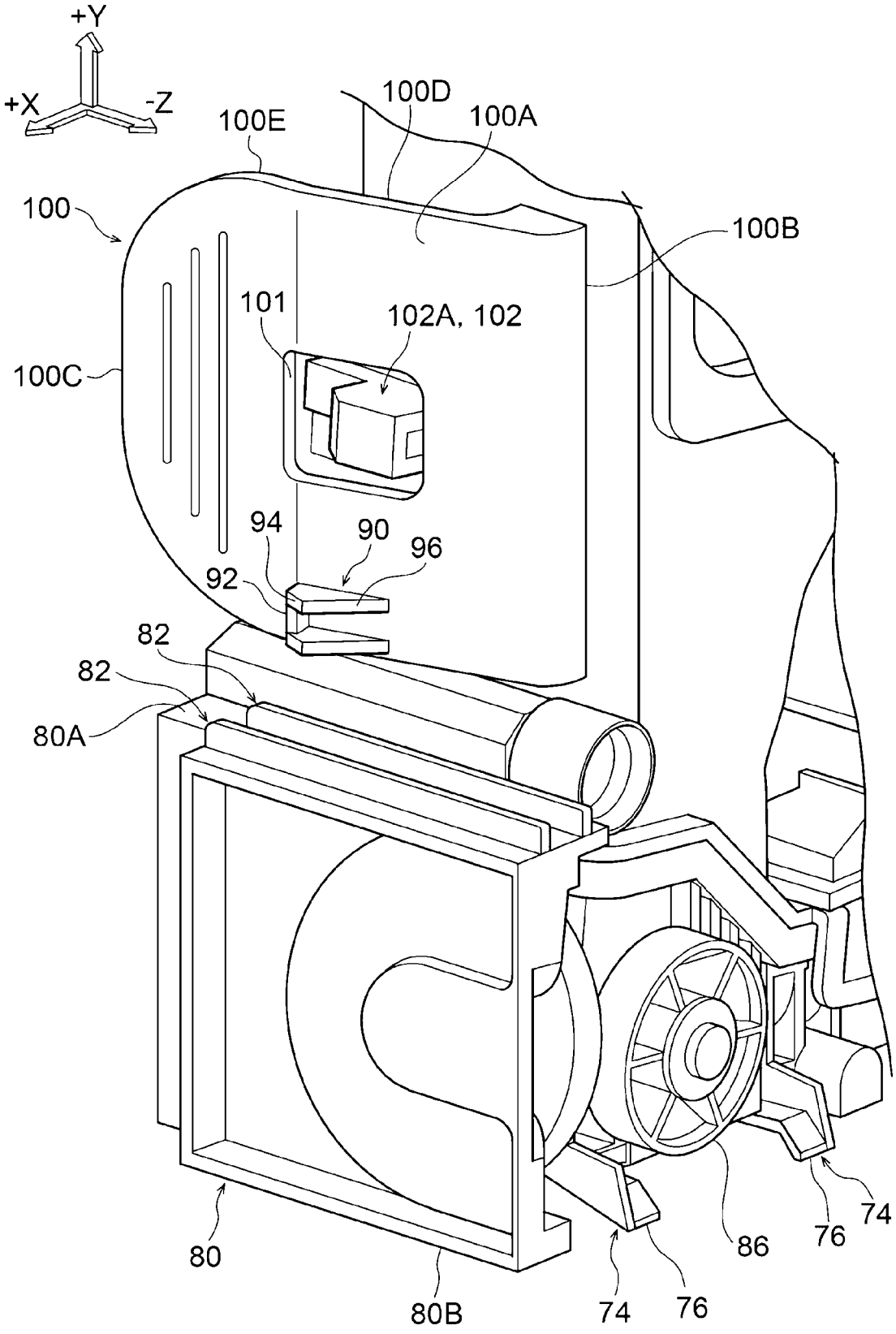
FIG. 10 is a perspective view of the relevant part of the recovery container in FIG. 9, as viewed from the opposite side to that in FIG. 9.

As shown in FIG. 10, in this exemplary embodiment, the guide parts 74 are provided on both sides of the external discharge port 68 in the width direction of the container body 62. Because the guide parts 74 support and guide the ends of the opening/closing shutter 72 in the width direction, rattling of the opening/closing shutter 72 when moving is suppressed. Because the guide parts 74 have the inclined portions 76, the flange portion 52A of the recovery port 52 is stably guided.

Figure 9:
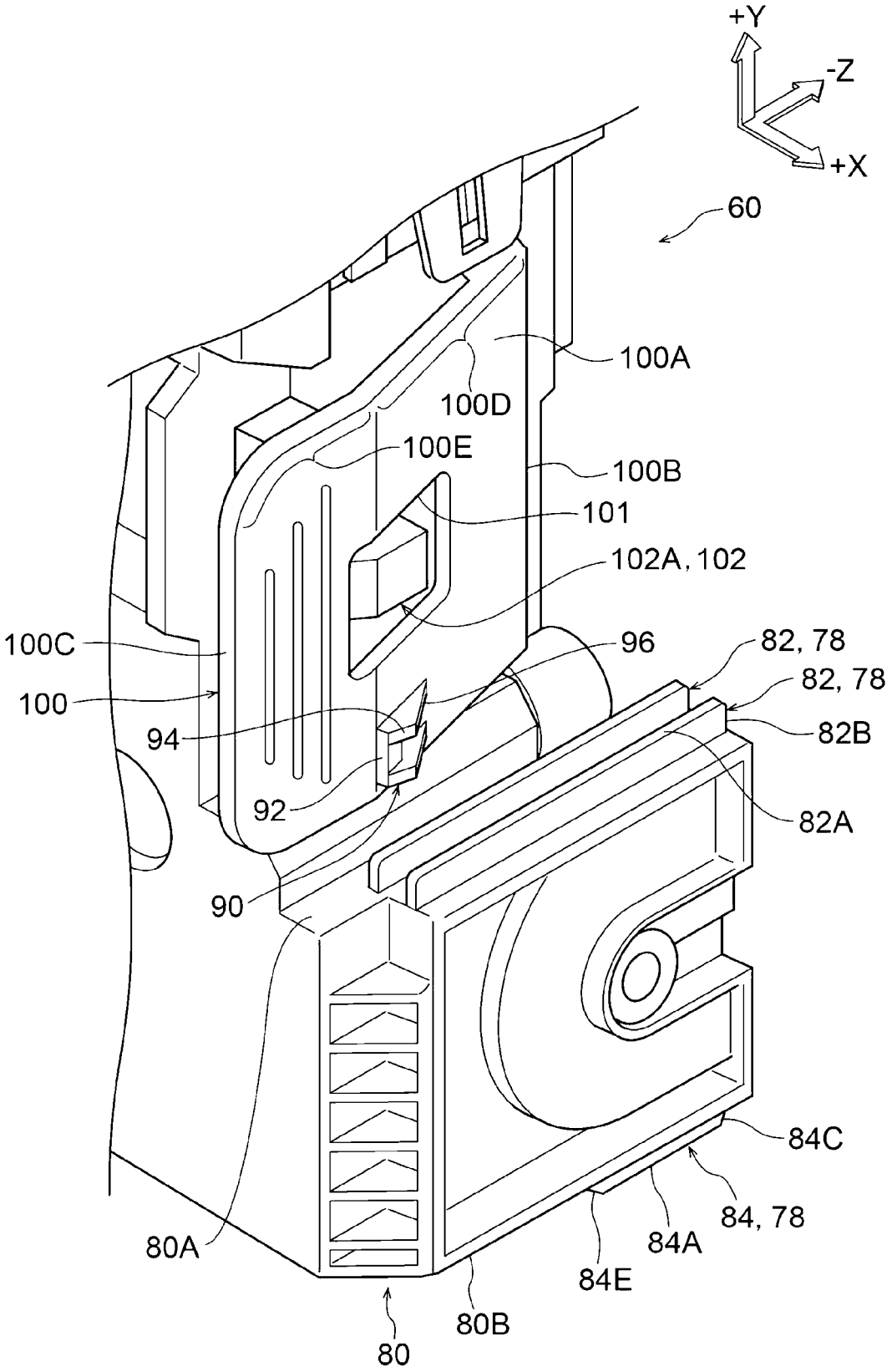
FIG. 9 is a perspective view of the relevant part of the recovery container according to the exemplary embodiment of the present disclosure.

As shown in FIGS. 9 and 11, the container body 62 has inclination suppressing parts 78 that come into contact with a portion of the housing 11 to suppress inclination of the container body 62 before the flange portion 52A of the recovery port 52 comes into contact with the opening/closing shutter 72. More specifically, a protruding part 80 protruding outward in the width direction is provided on the lower part of one side part 62B of the container body 62 in the width direction. The protruding part 80 has, on a top surface 80A thereof, first ridges 82 constituting the inclination suppressing parts 78 and, on a lower surface 80B thereof, a second ridge 84 constituting the inclination suppressing part 78.

Figure 20:
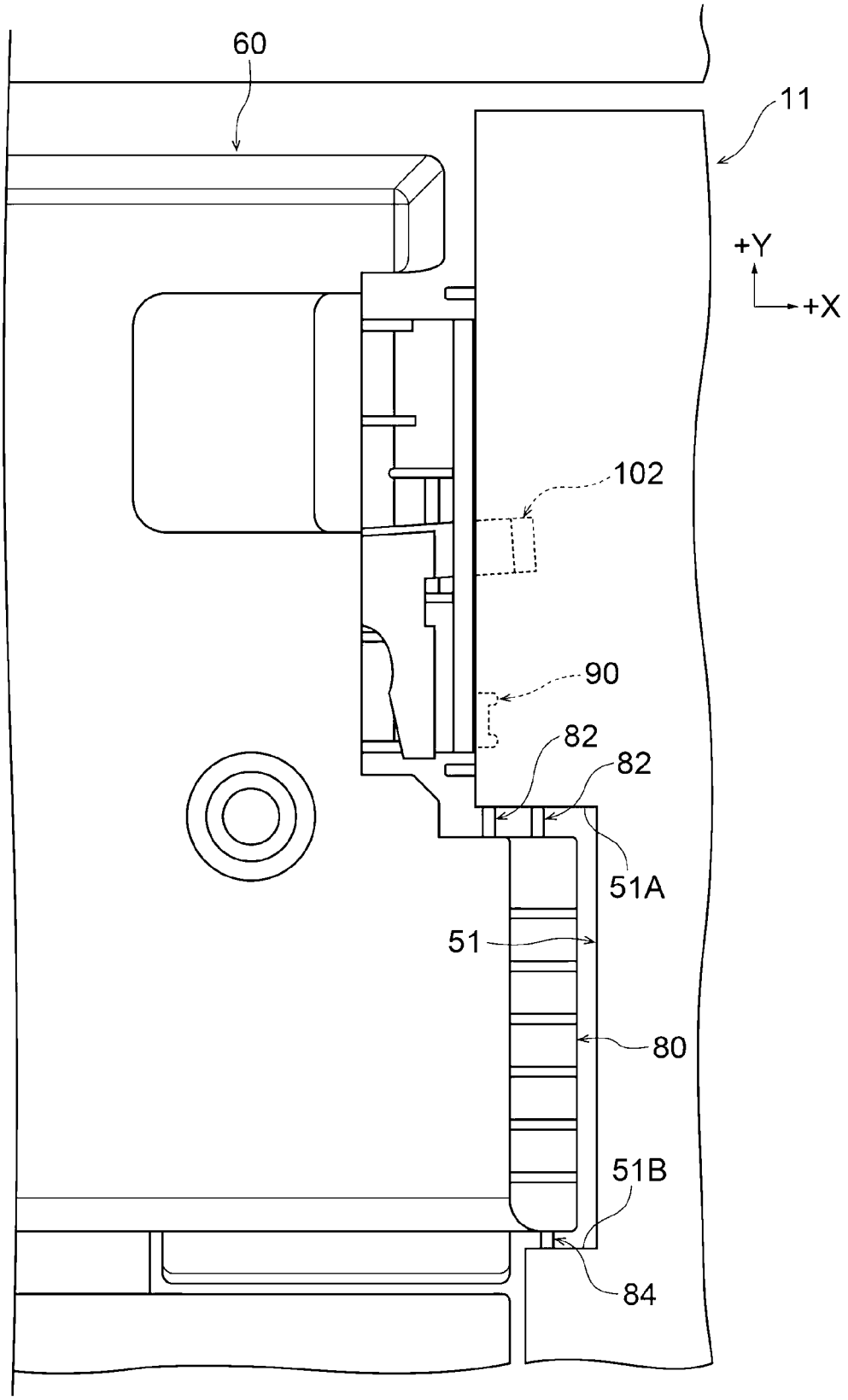
FIG. 20 is a front view showing the relevant part of the recovery container in the state in which the recovery container is attached to the housing.

As shown in FIGS. 9 to 11, the first ridges 82 project upward from the top surface 80A of the protruding part 80 and extend in the thickness direction of the container body (the attachment direction E). Tops 82A of the first ridges 82 are flat surfaces extending in the attachment direction E. When the container body 62 is attached to the housing 11, the tops 82A of the first ridges 82 come into contact with a ceiling 51A of a recess 51 in a side wall 50B of the storage part 50 corresponding to the protruding part 80 (see FIG. 20). In a state in which the recovery container 60 is attached to the housing 11, as shown in FIG. 20, the ceiling 51A and the first ridges 82 face each other. The ceiling 51A of the recess 51 in this exemplary embodiment is an example of a first wall of a storage part of the present disclosure.

Furthermore, the first ridges 82 have, at ends 82B on the attachment direction E side, inclined portions 82C (see FIG. 11) that are inclined such that the height of the first ridges 82 decreases from the tops 82A toward the bases.

Furthermore, in this exemplary embodiment, multiple (two) first ridges 82 are provided on the top surface 80A with a distance therebetween in the width direction of the container body 62 (see FIG. 20). Note that the present disclosure is not limited to this configuration, and the number of the first ridges 82 may be one, or three or more.

As shown in FIG. 11, the second ridge 84 projects downward from the lower surface 80B of the protruding part 80 and extends in the thickness direction of the container body 62 (the attachment direction E). A top 84A of the second ridge 84 is a flat surface extending in the attachment direction E. Furthermore, when the container body 62 is attached to the housing 11, the top 84A comes into contact with a bottom surface 51B of the recess 51 (see FIG. 20). As shown in FIG. 20, in a state in which the recovery container 60 is attached to the housing 11, the bottom surface 51B and the second ridge 84 face each other. Furthermore, in this exemplary embodiment, the bottom surface 51B of the recess 51 is an example of a second wall of the storage part of the present disclosure.

Furthermore, the second ridge 84 has, at an end 84B on the attachment direction E side, an inclined portion 84C (see FIG. 11) that is inclined such that the height of the second ridge 84 decreases from the top 84A toward the base. Moreover, in this exemplary embodiment, the second ridge 84 has, at an end 84D on the side opposite to the attachment direction E side, an inclined portion 84E that is inclined such that the height of the second ridge 84 decreases from the top 84A toward the base (see FIG. 11).

Furthermore, in this exemplary embodiment, one second ridge 84 is provided on the lower surface 80B (see FIG. 20). Note that the present disclosure is not limited to this configuration, and the number of the second ridge 84 may be more than one.

A connector 86 (see FIG. 10), serving as an example of a force transmission part for rotating the transport auger 70, is provided near the external discharge port 68 in the container body 62. More specifically, the connector 86 is provided at the lower part of the side part 62B of the container body 62. In a state in which the container body 62 is attached to the housing 11, the connector 86 is connected to a rotary drive part (not shown) provided on the housing 11 and converts the rotational force from the rotary drive part to the rotational force for the transport auger 70. In a state in which the container body 62 is attached to the housing 11, the rotational force from the rotary drive part is converted to the rotational force for the transport auger 70 via the connector 86, and the developer recovered in the principal passage 64A is transported to the external discharge port 68 as the transport auger 70 rotates.

Furthermore, the container body 62 has multiple recovery ports 66, through which the developer is recovered from the housing 11 side, in a rear part 62E (rear-side portion in the apparatus depth direction). The recovery ports 66 are provided on the recovery path 64 in the container body 62. The recovery ports 66 is connectable to developer discharge units 40, serving as an example of a powder discharge unit, on the housing 11 side. In a state in which the recovery ports 66 and the developer discharge units 40 are connected, the developer discharged from the developer discharge units 40 is recovered through the recovery ports 66 and is directed to the recovery path 64 (from the branch passages to the principal passage 64A). More specifically, in this exemplary embodiment, the developer used in the developing devices 18, the developer removed from the intermediate transfer belt 36, and the developer removed from the photoconductors 12 are recovered through the recovery ports 66. Recovery ports through which the developer discharged from the developer discharge units 40 in the developing devices 18 is recovered are denoted by reference sign 66A (see FIG. 5), recovery ports through which the developer removed from the photoconductors 12 by the cleaning devices 26 is recovered are denoted by reference sign 66B (see FIG. 5), and a recovery port through which the developer removed from the intermediate transfer belt 36 by a belt cleaning member (not shown) is recovered is denoted by reference sign 66C (see FIG. 5).

The recovery ports 66A are openable and closable by opening/closing shutters 67 urged in the attachment direction E by coil springs, serving as an example of an urging member (not shown). In an attached state in which the container body 62 is attached to the housing 11, the opening/closing shutters 67 are pushed in the direction opposite to the attachment direction E by peripheries of the developer discharge units 40 and open the recovery ports 66A (see FIG. 6). In a removed state in which the container body 62 is removed from the housing 11, the opening/closing shutters 67 close the recovery ports 66A (see FIG. 7).

Figure 16:
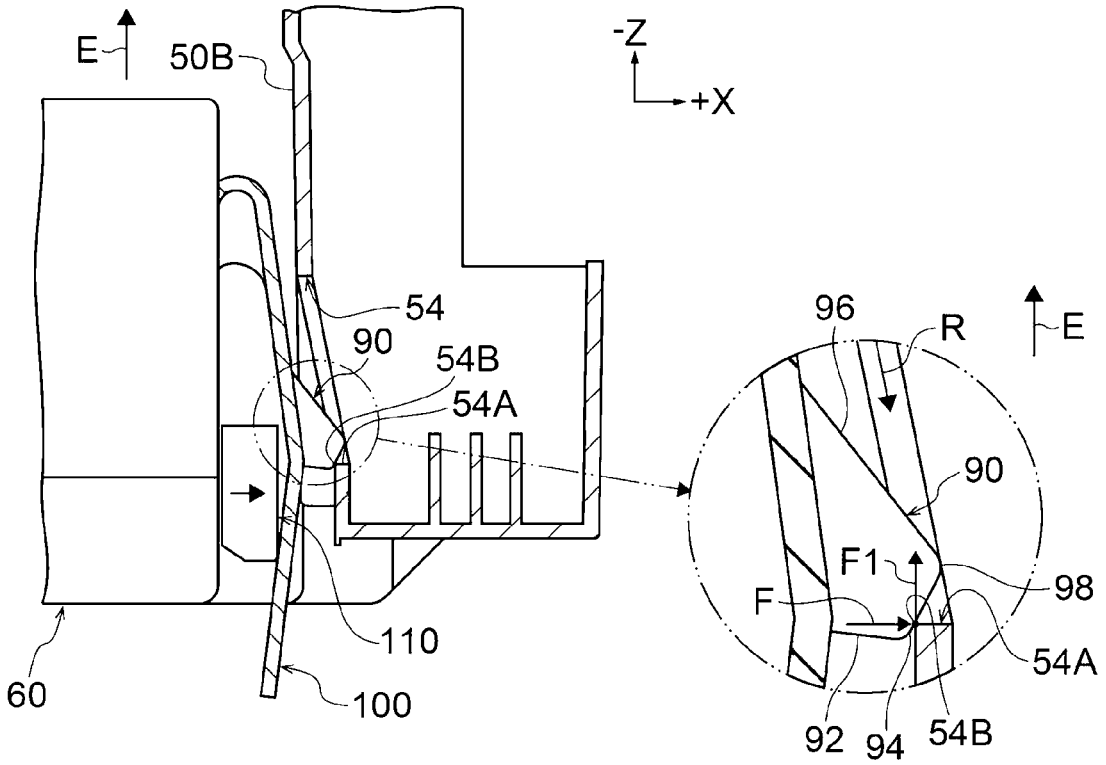
FIG. 16 is an enlarged plan view showing a state in which first inclined portions of the projection are in contact with an end of an engaging part in a state in which the recovery container is being moved relative to the housing, in the attachment direction.
Figure 17:
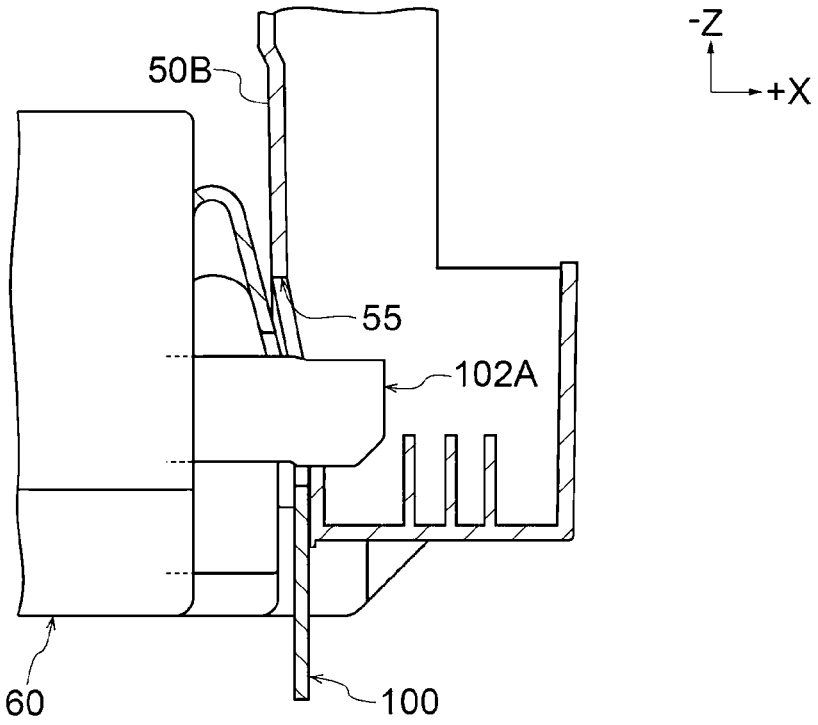
FIG. 17 is an enlarged plan view showing a state in which the recovery container is moved relative to the housing, in the attachment direction, and the lock part is inserted into an opening.
Figure 19:
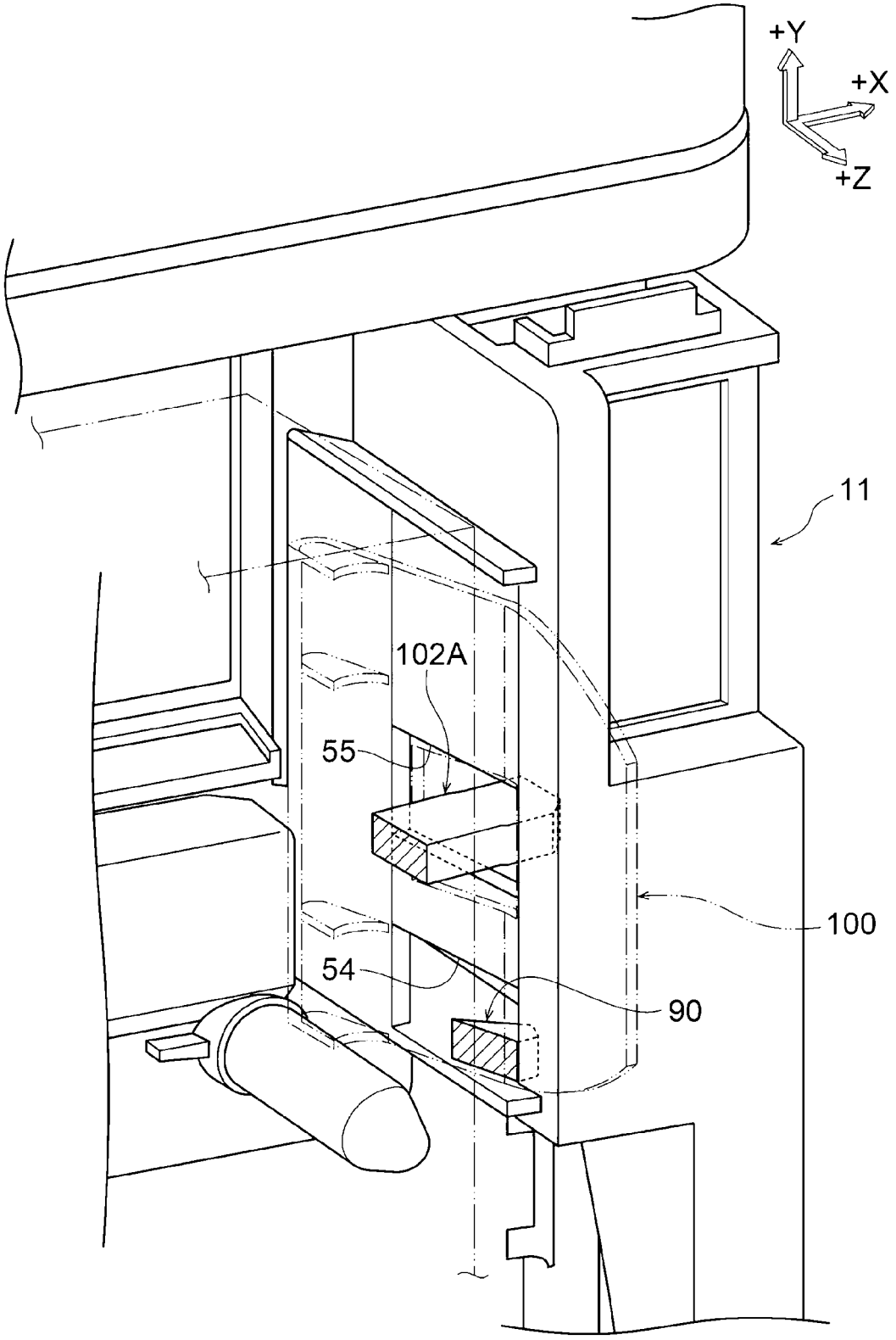
FIG. 19 is an enlarged perspective view of the relevant part in a storage part, showing a state in which the recovery container is attached to the housing.

Furthermore, as shown in FIGS. 10 and 16, a projection 90 is provided at a distance from the container body 62 in a direction intersecting with the attachment direction E. More specifically, the projection 90 is provided at a distance from and on the outer side of the upper part of the side part 62B of the container body 62 in the width direction. More specifically, the projection 90 is provided on a surface 100A of an attachment/detachment handle 100, which will be described in detail below, and projects outward from the surface 100A in the width direction of the container body 62. The projection 90 is configured to be engaged with an engaging part 54A formed on the side wall 50B on one side (right side in FIGS. 14 and 19) of the storage part 50 in the apparatus width direction. Herein, the engaging part 54A is a wall portion located in front of an opening 54 provided in the side wall 50B in the apparatus depth direction. Furthermore, an end 54B of the engaging part 54A, which will be described below, is a corner located at the boundary between the side wall 50B and the engaging part 54A. Furthermore, the opening 54 is provided above the recess 51 in the side wall 50B.

In this exemplary embodiment, the projection 90 has a slip-off preventing portion 92 formed at a portion on the side opposite to the attachment direction E side. When the slip-off preventing portion 92 is engaged with the engaging part 54A, detachment of the projection 90 from the engaging part 54A (releasing of engagement) is prevented (see FIG. 18). The slip-off preventing portion 92 of the projection 90 is a flat surface extending in the width direction of the container body 62.

Furthermore, the projection 90 has first inclined portions 94 inclined so as to be gradually separated from the container body 62, in the attachment direction E from the slip-off preventing portion 92. When viewed from above, the first inclined portions 94 are flat surfaces extending at an angle to the attachment direction E.

Figure 18:
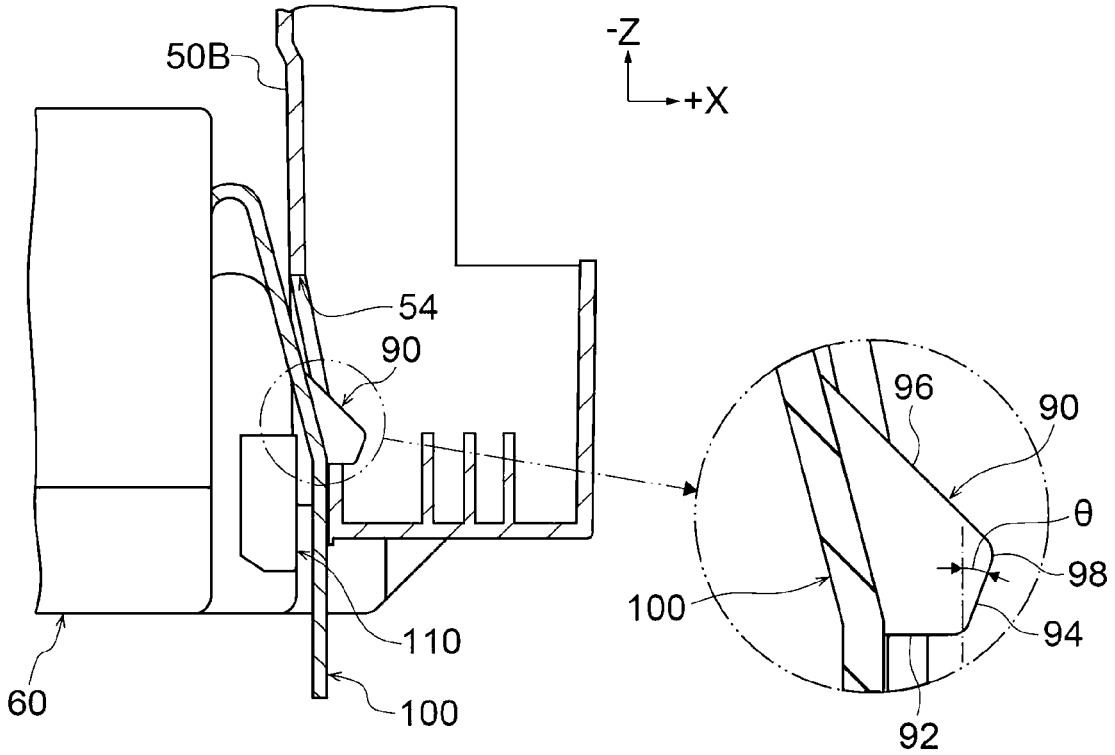
FIG. 18 is an enlarged plan view showing a state in which the recovery container is moved relative to the housing, in the attachment direction, and the projection is engaged with the engaging part.

Furthermore, as shown in FIG. 18, the projection 90 has second inclined portions 96 formed on the attachment direction E side of the first inclined portions 94. The second inclined portions 96 are inclined so as to gradually approach the container body 62, in the attachment direction E. When viewed from above, the second inclined portions 96 are flat surfaces extending at an angle to the attachment direction E, in the direction opposite to the direction in which the first inclined portions 94 are inclined.

Furthermore, the projection 90 has curved portions 98, which is curved in an arc shape, between the first inclined portions 94 and the second inclined portions 96. The curved portions 98 connect the first inclined portions 94 and the second inclined portions 96.

As shown in FIG. 18, the attachment/detachment handle 100, serving as an example of an urging member, that urges the projection 90 away from the container body 62 is provided between the container body 62 and the projection 90. More specifically, the attachment/detachment handle 100 is provided at the upper part of the side part 62B of the container body 62. More specifically, the attachment/detachment handle 100 is provided above the protruding part 80 on the side part 62B. The attachment/detachment handle 100 is a plate-shaped spring member whose one end 100B is supported by the side part 62B of the container body 62, and whose other end 100C is located farther from the attachment direction E side than the one end 100B is. In a state in which the recovery container 60 is removed, the other end 100C of the attachment/detachment handle 100 is in a free state. More specifically, as shown in FIG. 18, when viewed from above, the attachment/detachment handle 100 includes: an inclined plate portion 100D extending from the one end 100B toward the side away from the side part 62B, that is, in the direction opposite to the attachment direction E (i.e., toward the outside in the width direction of the container body 62); and a grip plate portion 100E extending from the end of the inclined plate portion 100D in the direction opposite to the attachment direction E. The inclined plate portion 100D is longer than the grip plate portion 100E. The other end 100C of the attachment/detachment handle 100 protrudes from a front side 62DA of the container body 62 toward the other side in the thickness direction of the container body 62 (front side in the apparatus depth direction). Because the grip plate portion 100E partially protrudes from the front side 62DA toward the front side in the apparatus depth direction, it is easy to operate the attachment/detachment handle 100 when the recovery container 60 is removed from the housing 11.

Figure 14:
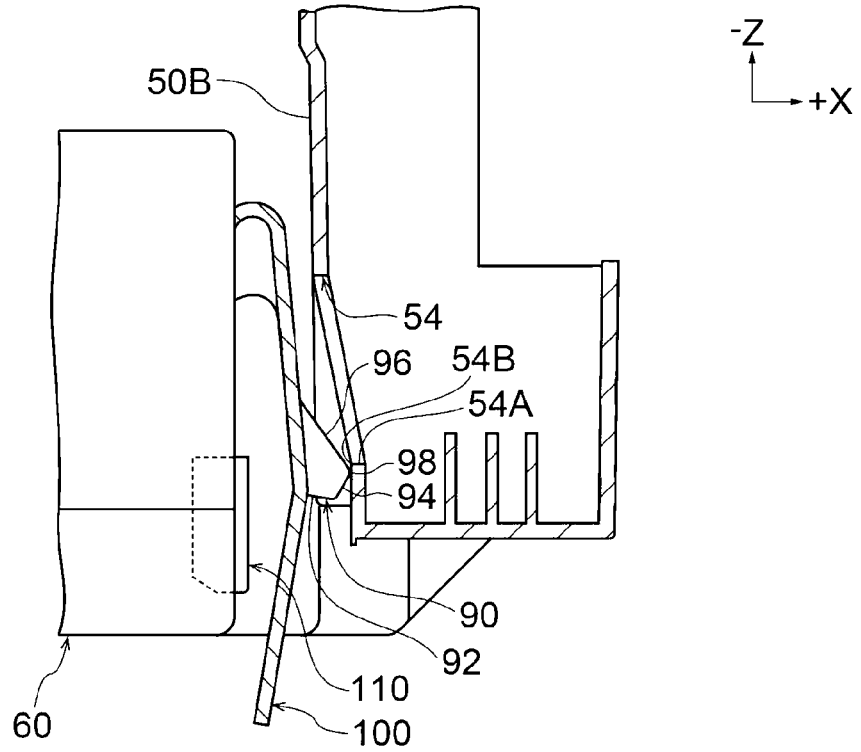
FIG. 14 is an enlarged plan view of a projection in a state in which the recovery container is being moved relative to the housing, in the attachment direction.

Furthermore, the attachment/detachment handle 100 has, on the surface 100A of the other end 100C, the projection 90. More specifically, the projection 90 is provided at an end of the inclined plate portion 100D near the grip plate portion 100E. As shown in FIG. 14, when the recovery container 60 (container body 62) is attached to the housing 11, the attachment/detachment handle 100 is subjected to a force toward the inside in the width direction of the container body 62 from the projection 90, which is in contact with the side wall 50B of the storage part 50. As a result, the one end 100B is deflected, and the other end 100C moves toward the inside in the width direction of the container body 62. When the projection 90 reaches the opening 54 in the storage part 50, as shown in FIG. 18, the slip-off preventing portion 92 of the projection 90 is engaged with the engaging part 54A. In this exemplary embodiment, although the projection 90 has a groove (recess) extending in the attachment direction E in the middle in the height direction of the container body 62, the present disclosure is not limited to this configuration.

Figure 15:
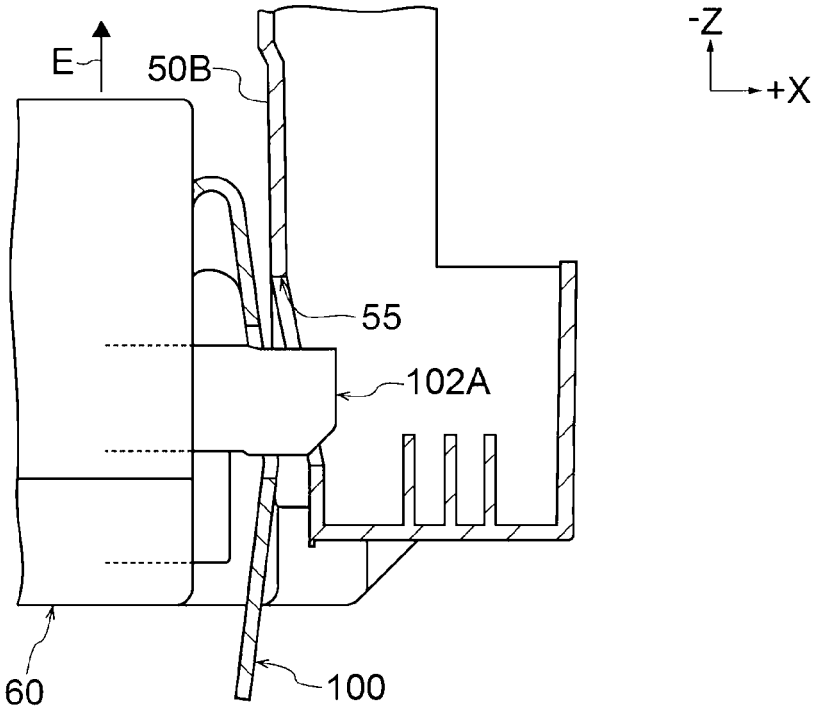
FIG. 15 is an enlarged plan view showing a state in which the lock part is operated in a state in which the recovery container is being moved relative to the housing, in the attachment direction.

As shown in FIGS. 10 and 15, the attachment/detachment handle 100 has an opening 101 through which a lock part 102A of a lock member 102 (described below) passes. More specifically, the opening 101 is in the inclined plate portion 100D and the grip plate portion 100E of the attachment/detachment handle 100. The projection 90 is located below the opening 101 in the inclined plate portion 100D. More specifically, the projection 90 is located near the lower end of the inclined plate portion 100D.

Furthermore, an attachment/detachment handle 104 is provided at the lower part of a side part 62C of the container body 62, which is on the other side (left side in FIGS. 7 and 8) in the width direction. The attachment/detachment handle 104 is a plate-shaped spring member whose one end 104B is supported by the lower part of the side part 62C of the container body 62, and whose other end 104C is located farther from the attachment direction E side than the one end 104B is. In the state in which the recovery container 60 is removed, the other end 104C of the attachment/detachment handle 104 is in a free state. The attachment/detachment handle 104 includes: an inclined plate portion 104D extending from the one end 104B toward the side away from the side part 62B, that is, in the direction opposite to the attachment direction E (i.e., toward the outside in the width direction of the container body 62); and a grip plate portion 104E extending from the end of the inclined plate portion 104D in the direction opposite to the attachment direction E. The inclined plate portion 104D is longer than the grip plate portion 104E. Note that the other end 104C of the attachment/detachment handle 104 protrudes from the front side 62DA of the container body 62 toward the other side in the thickness direction of the container body 62 (front side in the apparatus depth direction). Because the grip plate portion 104E partially protrudes from the front side 62DA toward the front side in the apparatus depth direction, it is easy to operate the attachment/detachment handle 104 when the recovery container 60 is removed from the housing 11.

Figure 5:
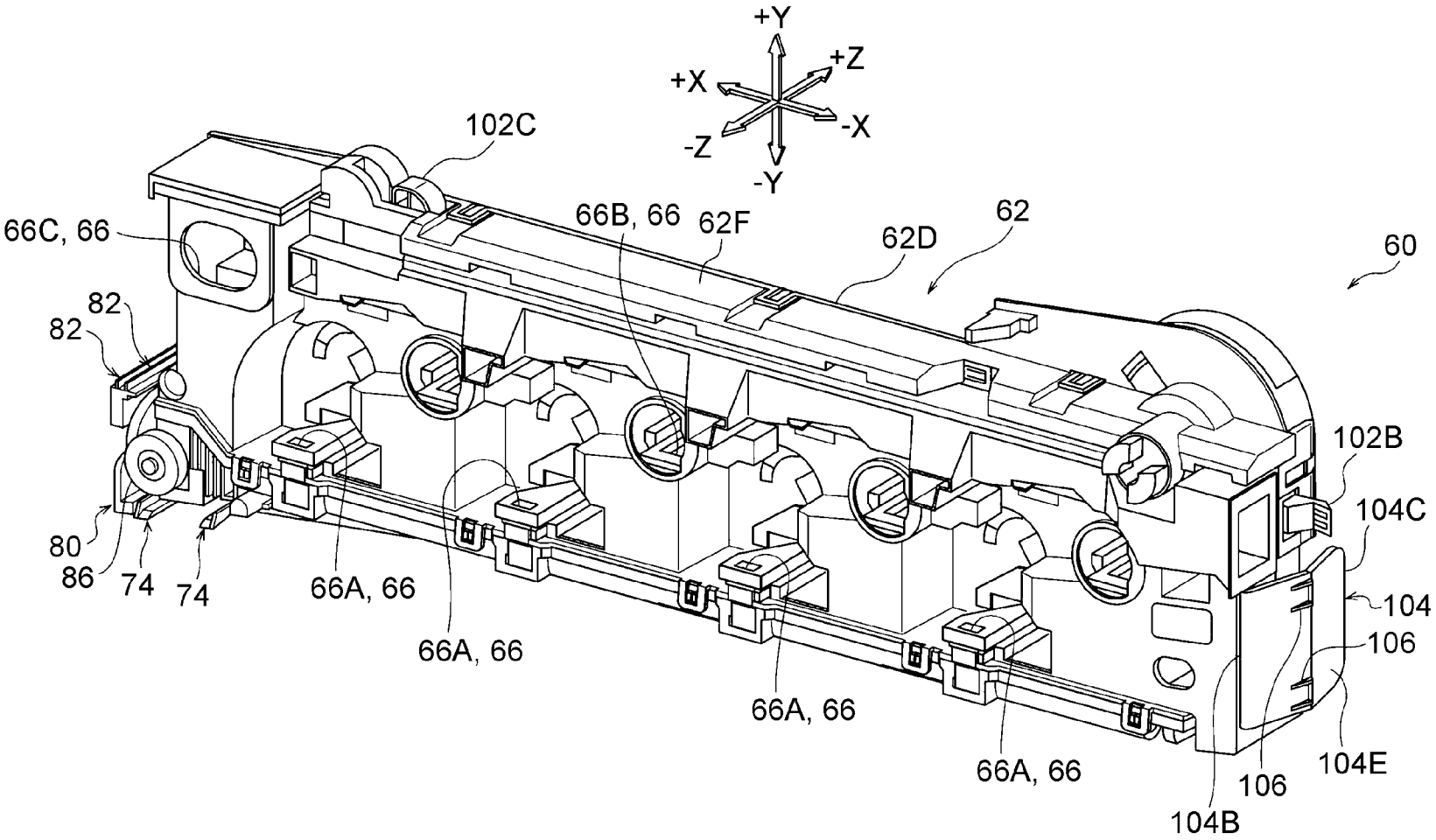
FIG. 5 is a perspective view of the recovery container in FIG. 4, as viewed from the rear side, showing a state in which the recovery container is locked to the housing.
Figure 6:
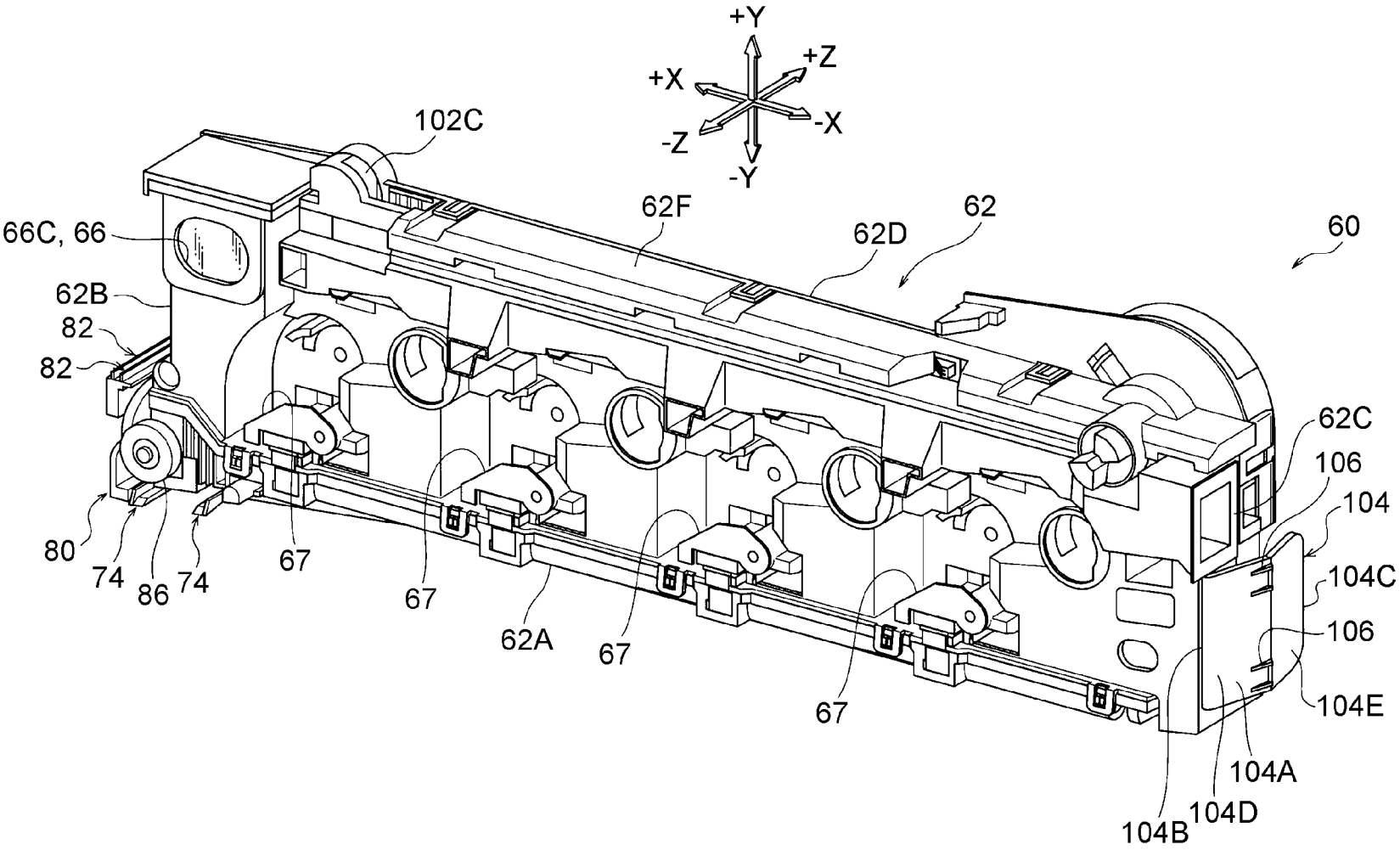
FIG. 6 is a perspective view of the recovery container in FIG. 4, as viewed from the rear side, showing a state in which the recovery container is unlocked (i.e., locking is released) from the housing.

Furthermore, as shown in FIGS. 5 and 6, the attachment/detachment handle 104 has, on a surface 104A near the other end 104C, projections 106. More specifically, the projections 106 are provided at an end of the inclined plate portion 104D near the grip plate portion 104E. In this exemplary embodiment, although the projections 106 have a groove (recess) extending in the attachment direction E in the middle in the height direction of the container body 62, the present disclosure is not limited to this configuration. Furthermore, the projections 106 are configured to be engaged with engaging parts (not shown) formed in a side wall 50C (left side wall in FIGS. 7 and 8) of the storage part 50. When the recovery container 60 (container body 62) is attached to the housing 11, the attachment/detachment handle 104 is subjected to a force toward the inside in the width direction of the container body 62 from the projections 106, which are in contact with the side wall 50C of the storage part 50. As a result, the one end 104B is deflected, and the other end 104C moves toward the inside in the width direction of the container body 62. When the projections 106 reach the engaging parts in the side wall 50C, the projections 106 are engaged with the engaging parts. In this exemplary embodiment, two projections 106 are provided at a distance from each other in the height direction of the container body 62.

As a result of the projection 90 and the projections 106 on the recovery container 60 being engaged with the engaging part 54A and engaging parts (not shown), respectively, the recovery container 60 is held by (attached to) the housing 11. Furthermore, by gripping the other end 100C of the attachment/detachment handle 100 and the other end 104C of the attachment/detachment handle 104, which are located on both sides of the recovery container 60, and pushing them inward in the width direction, the projection 90 and the projections 106 are detached (disengaged) from the engaging part 54A and the engaging parts (not shown). By pulling out the recovery container 60 in this state from the housing 11 in the direction opposite to the attachment direction E, the recovery container 60 is removed from the housing 11.

As shown in FIG. 16, it is desirable that, when the container body 62 is attached to the housing 11 and in a state in which the first inclined portions 94 of the projection 90 are in contact with the end 54B of the engaging part 54A, an inclination angle θ (see FIG. 18) of the first inclined portions 94 of the projection 90 with respect to the attachment direction E be set such that a force F1, which is converted from a repulsive force (urging force) F of the attachment/detachment handle 100 and which moves the container body 62 in the attachment direction, is greater than a repulsive force (total repulsive force) R applied to the container body 62 from the coil spring that urges the opening/closing shutters 67.

As shown in FIG. 14, the container body 62 has a pushing part 110. More specifically, the pushing part 110 is provided on the side part 62B of the container body 62 so as to be movable from the inside toward the outside in the width direction of the container body 62. More specifically, the pushing part 110 is movable from a first position shown in FIG. 14 to a second position shown in FIG. 18, which is located further on the outer side of the first position in the width direction of the container body 62. When moved from the first position to the second position, the pushing part 110 is capable of pushing the other end 100C of the attachment/detachment handle 100 to be away from the container body 62 (toward the outside in the width direction) (see FIG. 16). More specifically, in attaching the recovery container 60 to the housing 11, when the pushing part 110 is moved from the first position to the second position with the attachment/detachment handle 100 being elastically deformed toward the inside in the width direction of the container body 62 (loaded state), the pushing part 110 pushes the other end 100C of the attachment/detachment handle 100 (more specifically, the grip plate portion 100E) toward the outside in the width direction. The pushing part 110 moves in association with the lock member 102 (described below).

As shown in FIGS. 7 and 8, the container body 62 has the lock member 102 that maintains the recovery container 60 attached to the housing 11 by the operation of the operation handle 88. The lock member 102 includes the lock part 102A projecting from the side part 62B of the container body 62 outward in the width direction of the container body 62 and a lock part 102B projecting from the side part 62C outward in the width direction of the container body 62.

Figure 13:
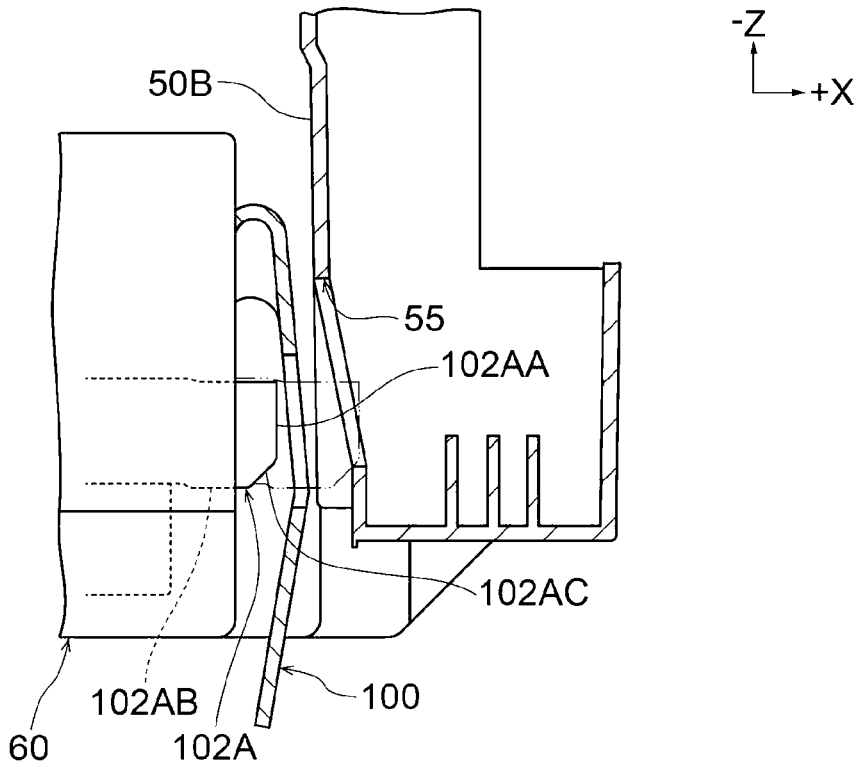
FIG. 13 is an enlarged plan view of a lock part in a state in which the recovery container is being moved relative to the housing, in an attachment direction.

As shown in FIGS. 9 and 13, the lock part 102A has a substantially rectangular-parallelepiped shape and has an inclined surface 102AC extending from an end surface 102AA toward a side surface 102AB on the other side in the thickness direction of the container body 62 (front side in the apparatus depth direction). The lock part 102A caused to project outward in the width direction of the container body 62 by the operation of the operation handle 88 passes through the opening 101 in the attachment/detachment handle 100 and is inserted into an opening 55 provided in the side wall 50B of the storage part 50.

As shown in FIGS. 5 and 6, the lock part 102B projects from the upper part of the side part 62C of the container body 62 outward in the width direction of the container body 62. More specifically, the lock part 102B projects from above the attachment/detachment handle 104 on the side part 62C of the container body 62 outward in the width direction of the container body 62. The lock part 102B has a substantially rectangular-parallelepiped shape. The lock part 102B caused to project outward in the width direction of the container body 62 by the operation of the operation handle 88 is inserted into an opening (not shown) provided in the side wall 50C of the storage part 50. The lock part 102A and the lock part 102B project outward in the width direction by the operation of the operation handle 88 in an associated manner.

The lock member 102 also includes a lock part 102C projecting from a top 62F of the container body 62.

As shown in FIGS. 5 and 7, the lock part 102C projects upward from the top 62F of the container body 62. More specifically, the lock part 102C projects upward from a portion of the top 62F of the container body 62 near the side part 62C. The lock part 102C has a substantially rectangular-parallelepiped shape. The lock part 102C caused to project upward by the operation of the operation handle 88 is engaged with an engaging part (not shown) provided on a ceiling 50D of the storage part 50. The lock part 102C projects upward in association with the lock part 102A and the lock part 102B by the operation of the operation handle 88.

The lock part 102A may be configured to move linearly in the width direction of the container body 62 and project to the outside from the side part 62B in the width direction by the operation of the operation handle 88 or may be configured to project to the outside from the side part 62B in the width direction by rotational movement. The lock part 102B and the lock part 102C may have the same configuration as the lock part 102A.

The lock member 102 and the pushing part 110 are formed as an integral part. More specifically, the pushing part 110 is formed integrally with the periphery of the lock part 102A of the lock member 102. Hence, in association with the operation of the lock part 102A projecting from the side part 62B outward in the width direction of the container body 62, the pushing part 110 moves outward in the width direction of the container body 62.

Furthermore, the operation handle 88 is provided on the front part 62D of the container body 62. The operation handle 88 is connected to the lock member 102. By operating the operation handle 88, locking (maintaining the attached state) and unlocking (releasing the maintaining of the attached state) of the recovery container 60 with the lock member 102 is capable of being switched. More specifically, when the operation handle 88 is rotated clockwise in a state in which the recovery container 60 is attached to the housing 11, the lock member 102 is operated by the operation force of the operation handle 88, and the lock part 102A, the lock part 102B, and the lock part 102C project from the container body 62. Thus, the recovery container 60 is locked to the housing 11. At this time, an opening/closing mechanism (not shown) is operated by the operation of the operation handle 88, and the recovery ports 66A are opened. Furthermore, the first transfer rollers 34 separated from the photoconductors 12 by a moving mechanism (not shown) move toward the photoconductors 12. In contrast, when the operation handle 88 is rotated counterclockwise, the lock member 102 is operated by the operation force of the operation handle 88, and the recovery container 60 is unlocked from the housing 11. At this time, the opening/closing mechanism (not shown) is operated by the operation of the operation handle 88, and the recovery ports 66A are closed. Furthermore, the moving mechanism (not shown) moves the first transfer rollers 34 away from the photoconductors 12.

Next, the effects of this exemplary embodiment will be described.

In the recovery container 60 according to this exemplary embodiment, as a result of the slip-off preventing portion 92 of the projection 90 provided on the container body 62 being engaged with the engaging part 54A provided on the housing 11, the container body 62 is held by (attached to) the housing 11.

The projection 90 has the first inclined portions 94 that are inclined from the slip-off preventing portion 92, so as to be gradually separated from the container body 62 in the attachment direction E. Hence, even when the container body 62 is not sufficiently pushed into the housing 11 in the attachment direction E, and thus, the projection 90 does not reach a position where the slip-off preventing portion 92 is engaged with the engaging part 54A, as shown in FIG. 16, the end 54B of the engaging part 54A comes into contact with the first inclined portions 94 of the projection 90, the urging force (repulsive force) F of the attachment/detachment handle 100 is converted to the moving force F1 in the attachment direction E by the first inclined portions 94, and the container body 62 is moved in the attachment direction E, together with the projection 90, by the moving force F1. When the end 54B of the engaging part 54A has moved from the first inclined portions 94 of the projection 90 to the slip-off preventing portion 92, the slip-off preventing portion 92 of the projection 90 is engaged with the engaging part 54A of the housing 11, and the container body 62 is attached to (held by) the housing (see FIG. 18).

As described above, with the recovery container 60 according to this exemplary embodiment, faulty engagement of the projection 90 with the engaging part 54A may be suppressed, compared with a case where the projection 90 has a flat portion extending from the slip-off preventing portion 92 in the attachment direction E. Note that "faulty engagement" as used herein represents a state in which the slip-off preventing portion 92 of the projection 90 is not in contact with the engaging part 54A.

Moreover, in the recovery container 60 according to this exemplary embodiment, when the first inclined portions 94 of the projection 90 come into contact with the end 54B of the engaging part 54A in a state in which the container body 62 is not sufficiently pushed into the housing 11 in the attachment direction E, the urging force F of the attachment/detachment handle 100 is converted to the force F1 for moving the container body 62 in the attachment direction E by the first inclined portions 94. As shown in FIG. 16, in the recovery container 60, because the moving force F1 in the attachment direction E of the container body 62 is greater than the urging force (repulsive force) R applied to the container body 62 from a coil spring that urges the opening/closing shutters 67, faulty engagement of the projection 90 with the engaging part 54A may be suppressed, compared with a configuration in which the moving force F1 in the attachment direction E of the container body 62 and the repulsive force (total repulsive force) R applied to the container body 62 from the opening/closing shutters 67 are equal.

Furthermore, in the recovery container 60 according to this exemplary embodiment, the second inclined portions 96 are formed on the projection 90. Hence, when the second inclined portions 96 come into contact with the side wall 50B of the storage part 50 when the recovery container 60 is attached to the housing 11, the moving force in the attachment direction E is converted to a force, by the second inclined portions 96, that pushes the projection 90 in the direction opposite to the urging direction exerted by the attachment/detachment handle 100. As described above, when the recovery container 60 is attached to the housing 11, the side wall 50B of the storage part 50 and the second inclined portions 96 come into contact with each other, and the projection 90 is pushed in the direction opposite to the urging direction exerted by the attachment/detachment handle 100. Hence, compared with a configuration in which portions extending toward the container body 62, in a direction (width direction of the container body 62) perpendicular to the attachment direction E, is provided on a further attachment direction side than the first inclined portions 94 of the projection 90 are, the projection 90 may be smoothly moved to the position of the engaging part 54A.

Furthermore, in the recovery container 60 according to this exemplary embodiment, because the first inclined portions 94 and the second inclined portions 96 of the projection 90 are connected to each other by the arc-shaped curved portions 98, when the recovery container 60 is attached to the housing 11, the contact portion with respect to the side wall 50B of the storage part 50 smoothly moves from the second inclined portions 96 toward the first inclined portions 94 through the curved portions 98. As described above, in the recovery container 60, the first inclined portions 94 and the second inclined portions 96 of the projection 90 are connected to each other by the curved portions 98. Hence, compared with a configuration in which the first inclined portions 94 and the second inclined portions 96 are connected to each other by an angular portion, the contact portion with respect to the housing 11 may be smoothly moved from the second inclined portions 96 to the first inclined portions 94 via the curved portions 98.

Furthermore, in the recovery container 60 according to this exemplary embodiment, a plate-shaped spring member having the projection 90 is used as the attachment/detachment handle 100. Hence, compared with a configuration in which the projection 90 is urged by using a coil spring, it is possible to apply an urging force to the projection 90 with a simple structure.

Furthermore, in the recovery container 60 according to this exemplary embodiment, as shown in FIG. 16, when the container body 62 is attached to the housing 11, even when the projection 90 does not reach a position where the slip-off preventing portion 92 is engaged with the engaging part 54A, by moving the pushing part 110 from the first position to the second position, the other end (free end) 100C side of the attachment/detachment handle 100 is pushed toward the side away from the container body 62, and the slip-off preventing portion 92 of the projection 90 is forcedly engaged with the engaging part 54A. As a result, the container body 62 is fitted to the housing 11.

As described above, in the recovery container 60, compared with a configuration in which the slip-off preventing portion 92 of the projection 90 is engaged with the engaging part 54A only by the urging force of the attachment/detachment handle 100, faulty engagement of the projection 90 with the engaging part 54A may be suppressed.

Furthermore, in the recovery container 60 according to this exemplary embodiment, when the lock member 102 is moved by the operation of the operation handle 88, the pushing part 110 moves in conjunction with the lock member 102. Hence, it is possible to engage the projection 90 with the engaging part 54A and to lock the container body 62 to the housing 11 by a single operation. As described above, in the recovery container 60, compared with a configuration in which the pushing part 110 and the lock member 102 operate separately, the operation may be simplified.

Furthermore, in the recovery container 60 according to this exemplary embodiment, because the pushing part 110 and the lock member 102 are formed as an integral part, compared with a configuration in which the pushing part 110 and the lock member 102 are formed as separate members, the component count may be reduced.

Furthermore, in the recovery container 60 according to this exemplary embodiment, the container body 62 has the opening/closing shutter 72 for closing the external discharge port 68. Hence, when the container body 62 is attached to the housing 11, the opening/closing shutter 72 is pushed in the direction opposite to the attachment direction E, and the external discharge port 68 is opened. At this time, a repulsive force in the direction opposite to the direction in which the opening/closing shutter 72 is urged is applied to the lower part of the side part 62B of the container body 62. However, in the recovery container 60, the projection 90 having the first inclined portions 94 is formed at the upper part of the side part 62B of the container body 62. Hence, compared with a configuration in which the projection 90 having no first inclined portions 94 is provided at the upper part of the side part 62B of the container body 62, faulty engagement of the projection 90 with the engaging part 54A may be suppressed, and inclination of the orientation of the container body 62 may be suppressed.

Moreover, in the recovery container 60 according to this exemplary embodiment, when the container body 62 is attached to the housing 11, the inclination suppressing parts 78 come into contact with the recess 51 in the storage part 50 to suppress inclination of the container body 62, before the flange portion 52A of the recovery port 52 in the housing 11 comes into contact with the opening/closing shutter 72 for the external discharge port 68 (see FIGS. 12A to 12C). Hence, in the recovery container 60, compared with a configuration in which the container body 62 is inclined when attached to the housing 11, the external discharge port 68 may be more reliably push-opened by the flange portion 52A of the recovery port 52.

More specifically, when the container body 62 is stored in the storage part 50, the tops 82A of the first ridges 82 come into contact with the ceiling 51A of the recess 51, and the top 84A of the second ridge 84 comes into contact with the bottom surface 51B of the recess 51, to suppress inclination of the orientation of the container body 62. Moreover, because the first ridges 82 and the second ridge 84 extend in the attachment direction, the container body 62 continues to be prevented from being inclined in the orientation thereof until the container body 62 is stored in the storage part 50. In addition, because the tops 82A of the first ridges 82 and the top 84A of the second ridge 84 come into contact with the corresponding ceiling 51A and bottom surface 51B of the storage part 50, the container body 62 may be smoothly stored in the storage part 50, compared with a configuration in which the top surface 80A and the lower surface 80B of the protruding part 80 of the container body 62 are brought into contact with the overall ceiling 51A and bottom surface 51B of the storage part 50.

Moreover, in the recovery container 60 according to this exemplary embodiment, by providing the inclined portions 82C and the inclined portion 84C on the first ridges 82 and the second ridge 84, respectively, the first ridges 82 and the second ridge 84 serve as guides and allow the container body 62 to be easily stored in the storage part 50. As described above, in the recovery container 60, the container body 62 may be easily stored in the storage part 50, compared with a configuration in which the ends of the first ridges 82 and the second ridge 84 on the attachment direction E side are angular.

Furthermore, in the recovery container 60 according to this exemplary embodiment, when the container body 62 is attached to the housing 11, as shown in FIGS. 12A to 12C, the flange portion 52A of the recovery port 52 is guided by the inclined portions 76 and comes into contact with the opening/closing shutter 72 between the guide parts 74 and the external discharge port 68, thus push-opening the opening/closing shutter 72. In this way, in the recovery container 60, compared with a configuration in which the guide parts 74 are extended in the attachment direction E, the flange portion 52A of the recovery port 52 may be guided toward the opening/closing shutter 72 located between the guide parts 74 and the external discharge port 68 by the inclined portions 76. Hence, the flange portion 52A may be brought into contact with the opening/closing shutter 72.

Furthermore, in the recovery container 60 according to this exemplary embodiment, the guide parts 74 are provided on both sides of the external discharge port 68 in the width direction of the container body 62. Hence, compared with a configuration in which the guide part 74 is provided on one side of the external discharge port 68 in the width direction of the container body 62, the flange portion 52A of the recovery port 52 may be stably guided to the position between the guide parts 74 and the external discharge port 68.

Furthermore, in the recovery container 60 according to this exemplary embodiment, the inclination of the recovery container 60 when attached to the housing 11 is suppressed. Hence, compared with a configuration in which the recovery container 60 is attached to the housing 11 in an inclined manner, the developer discharged from the developing devices 18, serving as an example of a supply part, may be more reliably recovered in the recovery container 60.

Moreover, in the recovery container 60 according to this exemplary embodiment, when pushing the recovery container 60 into the housing 11 in the attachment direction is far insufficient, the other end 100C of the attachment/detachment handle 100 is not pushed by the pushing part 110, and the lock part 102A comes into contact with the periphery of the opening 55 in the storage part 50. In this case, because the operation handle 88 does not rotate beyond a certain level, a user may recognize that pushing-in of the recovery container 60 is insufficient.

In the exemplary embodiment, the developer recovered in the recovery container 60 is discharged through the external discharge port 68 to the recovery bottle 58, via the recovery port 52, attached to the housing 11. However, the present disclosure is not limited to this configuration, and it is possible to use a recovery container 60 with no external discharge port 68 and to replace the recovery container 60 with a new one when the developer recovered in the recovery container 60 has reached a predetermined amount.

Furthermore, in the above-described exemplary embodiment, although the recovery container of the present disclosure is used in the image forming apparatus 10, the present disclosure is not limited to this configuration. The recovery container in the present disclosure may be used in an apparatus that forms images by using a method different from the method used in the image forming apparatus 10, as long as the recovery container is used for recovery of powder. Furthermore, the recovery container in the present disclosure does not necessarily have to be used in the image forming apparatus 10 and may be used in, for example, an apparatus for coating or applying powder (powder foodstuff, food additives, etc.,) to food.

In the above-described exemplary embodiment, the curved portions 98 connect the first inclined portions 94 and the second inclined portions 96 of the projection 90. However, the present disclosure is not limited to this configuration. For example, inclined portions extending at an angle with respect to the attachment direction E may connect the first inclined portions 94 and the second inclined portions 96 of the projection 90.

Although a specific exemplary embodiment of the present disclosure has been described in detail, it is obvious to those skilled in the art that the present disclosure is not limited to this exemplary embodiment and various other exemplary embodiments are possible within the scope of the present disclosure.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recovery container comprising:

a container body that is removably attached to an attachment target and that is capable of recovering powder;

a projection provided at a distance from the container body in a direction intersecting with an attachment direction of the container body and having a slip-off preventing portion that is formed at a portion on a side opposite to an attachment direction side and that is engaged with an engaging part provided at the attachment target;

an urging member that is provided between the container body and the projection and that urges the projection away from the container body; and an inclined portion formed at the projection and inclined so as to be gradually separated from the container body, in the attachment direction from the slip-off preventing portion.

2. The recovery container according to claim 1, wherein the projection includes a first inclined portion serving as the inclined portion, and a second inclined portion formed on the attachment direction side of the first inclined portion and inclined so as to gradually approach the container body, in the attachment direction.

3. The recovery container according to claim 2, wherein the projection has a curved portion that is curved in an arc shape and that connects the first inclined portion and the second inclined portion.

4. The recovery container according to claim 3, wherein the urging member is a plate-shaped spring member whose one end is supported by the container body, and whose other end is in a free state and is located farther from the attachment direction side than the one end is, and wherein the projection is provided on a surface of the other end of the spring member.

5. The recovery container according to claim 4, wherein the container body has a pushing part that is movable from a first position to a second position located farther from the container body than the first position and that is capable of pushing the other end of the spring member to be away from the container body by movement to the second position.

6. The recovery container according to claim 5, wherein the container body includes an operation member, and a lock member that projects from the container body and is inserted into an opening provided in the attachment target by an operation of the operation member to lock an attached state between the container body and the attachment target, and wherein the pushing part moves in association with the lock member.

7. The recovery container according to claim 3, wherein a recovery port is provided in a recovery path of the powder provided in the container body, a powder discharge unit provided at the attachment target being configured to be connected to the recovery port, wherein the recovery port is provided with an opening/closing member that is urged in the attachment direction to close the recovery port and, in a state in which the recovery container is attached to the attachment target, that is pushed in a direction opposite to the attachment direction by a periphery of the powder discharge unit to open the recovery port, and wherein, in a state in which the inclined part of the projection is in contact with an end of the engaging part, a force, which is converted from an urging force of the urging member and which moves the container body in the attachment direction, is greater than a force, which is applied to the container body from the opening/closing member and which urges the opening/closing member.

8. The recovery container according to claim 3, wherein a transport member is provided in a recovery path of the powder provided in the container body, the transport member being configured to rotate about an axis along an extending direction of the recovery path and transport the powder from one side to the other side in the extending direction of the recovery path, wherein, in an attached state in which the container body is attached to the attachment target, a force transmission part that is connected to a rotary drive part provided at the attachment target and that transmits a rotational force of the rotary drive part as a rotational force of the transport member, an external discharge port through which the powder transported to the other side in the extending direction of the recovery path is discharged outside of the container body, and an external opening/closing member that is urged in the attachment direction and that closes the external discharge port are provided at a lower part of the container body, and wherein the projection is disposed at an upper part of the container body on the other side in the extending direction of the recovery path.

9. The recovery container according to claim 2, wherein the urging member is a plate-shaped spring member whose one end is supported by the container body, and whose other end is in a free state and is located farther from the attachment direction side than the one end is, and wherein the projection is provided on a surface of the other end of the spring member.

10. The recovery container according to claim 9, wherein the container body has a pushing part that is movable from a first position to a second position located farther from the container body than the first position and that is capable of pushing the other end of the spring member to be away from the container body by movement to the second position.

11. The recovery container according to claim 10,
wherein the container body includes
an operation member, and
a lock member that projects from the container body and is inserted into an opening provided in the attachment target by an operation of the operation member to lock an attached state between the container body and the attachment target, and
wherein the pushing part moves in association with the lock member.

12. The recovery container according to claim 2,
wherein a recovery port is provided in a recovery path of the powder provided in the container body, a powder discharge unit provided at the attachment target being configured to be connected to the recovery port,
wherein the recovery port is provided with an opening/closing member that is urged in the attachment direction to close the recovery port and, in a state in which the recovery container is attached to the attachment target, that is pushed in a direction opposite to the attachment direction by a periphery of the powder discharge unit to open the recovery port, and
wherein, in a state in which the inclined part of the projection is in contact with an end of the engaging part, a force, which is converted from an urging force of the urging member and which moves the container body in the attachment direction, is greater than a force, which is applied to the container body from the opening/closing member and which urges the opening/closing member.

13. The recovery container according to claim 2,
wherein a transport member is provided in a recovery path of the powder provided in the container body, the transport member being configured to rotate about an axis along an extending direction of the recovery path and transport the powder from one side to the other side in the extending direction of the recovery path,
wherein, in an attached state in which the container body is attached to the attachment target, a force transmission part that is connected to a rotary drive part provided at the attachment target and that transmits a rotational force of the rotary drive part as a rotational force of the transport member, an external discharge port through which the powder transported to the other side in the extending direction of the recovery path is discharged outside of the container body, and an external opening/closing member that is urged in the attachment direction and that closes the external discharge port are provided at a lower part of the container body, and
wherein the projection is disposed at an upper part of the container body on the other side in the extending direction of the recovery path.

14. The recovery container according to claim 1,
wherein the urging member is a plate-shaped spring member whose one end is supported by the container body, and whose other end is in a free state and is located farther from the attachment direction side than the one end is, and
wherein the projection is provided on a surface of the other end of the spring member.

15. The recovery container according to claim 14, wherein the container body has a pushing part that is movable from a first position to a second position located farther from the container body than the first position and that is capable of pushing the other end of the spring member to be away from the container body by movement to the second position.

16. The recovery container according to claim 15,
wherein the container body includes
an operation member, and
a lock member that projects from the container body and is inserted into an opening provided in the attachment target by an operation of the operation member to lock an attached state between the container body and the attachment target, and
wherein the pushing part moves in association with the lock member.

17. The recovery container according to claim 14,
wherein a recovery port is provided in a recovery path of the powder provided in the container body, a powder discharge unit provided at the attachment target being configured to be connected to the recovery port,
wherein the recovery port is provided with an opening/closing member that is urged in the attachment direction to close the recovery port and, in a state in which the recovery container is attached to the attachment target, that is pushed in a direction opposite to the attachment direction by a periphery of the powder discharge unit to open the recovery port, and
wherein, in a state in which the inclined part of the projection is in contact with an end of the engaging part, a force, which is converted from an urging force of the urging member and which moves the container body in the attachment direction, is greater than a force, which is applied to the container body from the opening/closing member and which urges the opening/closing member.

18. The recovery container according to claim 14,
wherein a transport member is provided in a recovery path of the powder provided in the container body, the transport member being configured to rotate about an axis along an extending direction of the recovery path and transport the powder from one side to the other side in the extending direction of the recovery path,
wherein, in an attached state in which the container body is attached to the attachment target, a force transmission part that is connected to a rotary drive part provided at the attachment target and that transmits a rotational force of the rotary drive part as a rotational force of the transport member, an external discharge port through which the powder transported to the other side in the extending direction of the recovery path is discharged outside of the container body, and an external opening/closing member that is urged in the attachment direction and that closes the external discharge port are provided at a lower part of the container body, and
wherein the projection is disposed at an upper part of the container body on the other side in the extending direction of the recovery path.

19. The recovery container according to claim 1,
wherein a recovery port is provided in a recovery path of the powder provided in the container body, a powder discharge unit provided at the attachment target being configured to be connected to the recovery port,
wherein the recovery port is provided with an opening/closing member that is urged in the attachment direction to close the recovery port and, in a state in which the recovery container is attached to the attachment target, that is pushed in a direction opposite to the attachment direction by a periphery of the powder discharge unit to open the recovery port, and wherein, in a state in which the inclined part of the projection is in contact with an end of the engaging part, a force, which is converted from an urging force of the urging member and which moves the container body in the attachment direction, is greater than a force, which is applied to the container body from the opening/closing member and which urges the opening/closing member.

20. The recovery container according to claim 1, wherein a transport member is provided in a recovery path of the powder provided in the container body, the transport member being configured to rotate about an axis along an extending direction of the recovery path and transport the powder from one side to the other side in the extending direction of the recovery path, wherein, in an attached state in which the container body is attached to the attachment target, a force transmission part that is connected to a rotary drive part provided at the attachment target and that transmits a rotational force of the rotary drive part as a rotational force of the transport member, an external discharge port through which the powder transported to the other side in the extending direction of the recovery path is discharged outside of the container body, and an external opening/closing member that is urged in the attachment direction and that closes the external discharge port are provided at a lower part of the container body, and wherein the projection is disposed at an upper part of the container body on the other side in the extending direction of the recovery path.

* * * * *